United States Patent [19]

Sakanoue et al.

[11] Patent Number: 4,476,219

[45] Date of Patent: Oct. 9, 1984

[54] SILVER HALIDE COLOR PHOTOGRAPHIC MATERIAL

[75] Inventors: Kei Sakanoue; Shigeo Hirano; Takehiko Ueda; Keiichi Adachi, all of Kanagawa, Japan

[73] Assignee: Fuji Photo Film Co., Ltd., Kanagawa, Japan

[21] Appl. No.: 474,606

[22] Filed: Mar. 11, 1983

[30] Foreign Application Priority Data

Mar. 11, 1982 [JP] Japan ..... 57-38803

[51] Int. Cl.[3] ..... G03C 7/26

[52] U.S. Cl. ..... 430/542; 430/551; 430/553; 430/555; 430/557; 430/558

[58] Field of Search ..... 430/372, 551, 565, 264, 430/607, 553, 555, 557, 558, 542

[56] References Cited

U.S. PATENT DOCUMENTS

| | | | |
|---|---|---|---|
| 3,929,486 | 12/1975 | Habu et al. | 430/609 |
| 4,228,235 | 10/1980 | Okonogi et al. | 430/551 |
| 4,252,893 | 2/1981 | Iwamuro et al. | 430/551 |
| 4,268,621 | 5/1981 | Ogi et al. | 430/551 |
| 4,277,558 | 7/1981 | Kikuchi et al. | 430/551 |

*Primary Examiner*—J. Travis Brown

*Attorney, Agent, or Firm*—Sughrue, Mion, Zinn, Macpeak & Seas

[57] ABSTRACT

A silver halide color photographic material which is improved in granularity by containing both a gallic acid amide derivative represented by the following general formula (I) and a high speed reaction type coupler:

(I)

wherein $R^1$ and $R^2$ each represents a hydrogen atom, a substituted or an unsubstituted aliphatic group, a substituted or an unsubstituted aromatic group, or a substituted or an unsubstituted heterocyclic group, and they may be the same group provided that they are not simultaneously hydrogen atoms, and, further, they may combine with each other to form a ring.

4 Claims, No Drawings

SILVER HALIDE COLOR PHOTOGRAPHIC MATERIAL

FIELD OF THE INVENTION

This invention relates to a color photographic material and, more particularly, to a silver halide color photographic material improved in graininess.

BACKGROUND OF THE INVENTION

Making improvements in the graininess of silver halide photographic materials is an important subject in the field of such materials and much information relating thereto has been accumulated.

For instance, Japanese Patent Application (OPI) No. 62454/80 (corresponding to U.S. Pat. No. 4,264,723) (the term "OPI" as used herein refers to a "published unexamined Japanese patent application") discloses the use of a high speed reactive coupler. Therein, graininess in high density image areas is markedly improved. This is because such a coupler reacts rapidly with oxidation products of color developing agents and, consequently, a development restraining effect caused by oxidation products of color developing agents is diminished and, at the same time, the amount of developed silver in high exposure areas is increased. Under these conditions, all of the coupler molecules coated undergo the reaction and thereby any granular condition becomes inconspicuous, that is to say, disappearance of the granular structure occurs quickly. However, high speed reactive couplers have a serious defect that they form dye clouds of high densities due to the rapid reaction with oxidation products of color developing agents and thereby graininess in low density image areas is extremely deteriorated.

With the intention of obviating such a defect, methods of using high speed reactive couplers in combination with so-called DIR couplers or DIR compounds, which tend to break up dye clouds into fine pieces improving graininess are disclosed in U.S. Pat. Nos. 3,227,554 and 3,632,435, respectively. However, such methods are not desirable because restrainers released upon development counteract the effect of the high speed reactive couplers, that is, the effect of improving the graininess in high density image areas is suffered.

SUMMARY OF THE INVENTION

Therefore, an object of this invention is to provide a method for improving graininess in low density image areas without spoiling the effect of extinguishing a granular appearance in high density image areas which is brought about by high speed reactive couplers.

Another object of this invention is to provide a color photographic material which forms images having greatly improved graininess in both high density areas and low density areas.

As a result of various investigations, it has now been found that the above-described objects can be attained by adding a combination of gallic acid amide series compounds represented by the following general formula (I) with a high-speed reactive coupler to a silver halide color photographic material:

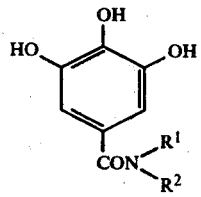

(I)

wherein $R^1$ and $R^2$ each represents a hydrogen atom, a substituted or unsubstituted aliphatic group, a substituted or unsubstituted aryl group, or a substituted or unsubstituted heterocyclic group, and they may combine with each other to form a ring and, further, they may be the same provided that they do not simultaneously represent a hydrogen atom.

DETAILED DESCRIPTION OF THE INVENTION

In the general formula (I), suitable examples of the aliphatic group represented by $R^1$ or $R^2$ include straight or branched chain alkyl groups, straight or branched chain alkenyl groups, cycloalkyl groups, and straight or branched chain alkynyl groups.

The straight or branched chain alkyl groups each has 1 to 30, preferably 1 to 20, carbon atoms. Specific examples thereof include methyl, ethyl, propyl, n-butyl, sec-butyl, t-butyl, n-hexyl, 2-ethylhexyl, n-octyl, t-octyl, n-dodecyl, n-hexadecyl, n-octadecyl, iso-stearyl, eicosyl and the like.

The straight or branched chain alkenyl groups each has 2 to 30, preferably 3 to 20, carbon atoms. Specific examples thereof include allyl, butenyl, pentenyl, octenyl, dodecenyl, oleyl and the like.

The cycloalkyl groups each has 3 to 12, preferably 5 to 7, carbon atoms. Specific examples thereof include cyclopropyl, cyclopentyl, cyclohexyl, cycloheptyl, cyclododecyl and the like.

The straight or branched chain alkynyl groups each has 3 to 30, preferably 3 to 22, carbon atoms. Specific examples thereof include propargyl, butynyl and the like.

Suitable examples of the aryl groups represented by $R^1$ or $R^2$ include phenyl and naphthyl.

Suitable examples of the heterocyclic groups represented by $R^1$ or $R^2$ include thiazolyl, oxazolyl, imidazolyl, furyl, thienyl, tetrahydrofuryl, piperidyl, thiadiazolyl, oxadiazolyl, benzothiazolyl, benzoxazolyl, benzimidazolyl and so on.

The ring formed by combining $R^1$ with $R^2$ contains 3 to 12 members, preferably 5 to 12 members. Specific examples of the moiety formed by combining $R^1$ with $R^2$ include ethylene, tetramethylene, pentamethylene, hexamethylene, dodecamethylene, $-CH_2CH_2OCH_2CH_2-$, $$-CH_2CH_2\underset{\underset{CH_3}{|}}{N}CH_2CH_2-,$$

and so on.

Each of the above-described groups may have an appropriate substituent. Suitable examples of such substituents include alkoxyl groups, aryloxy groups, hydroxy groups, alkoxycarbonyl groups, aryloxycarbonyl groups, halogen atoms, carboxy groups, sulfo groups, cyano groups, alkyl groups, alkenyl groups, aryl groups, alkylamino groups, arylamino groups, carbamoyl groups, alkylcarbamoyl groups, arylcarbamoyl groups, acyl groups, sulfonyl groups, acyloxy groups, acylamino groups, alkylthio groups, and so on.

Specific examples of the compound of this invention are illustrated below. However, the compound of this invention should not be construed as being limited to the following examples.

I-1

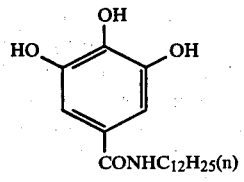

I-2

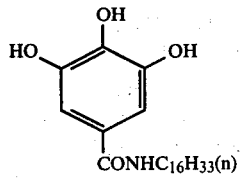

I-3

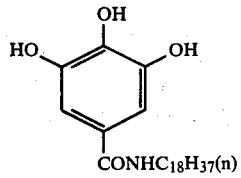

I-4

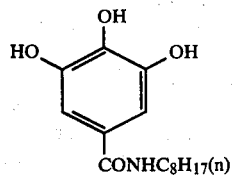

I-5

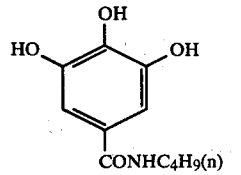

I-6

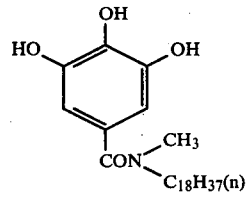

I-7

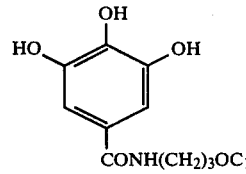

I-8

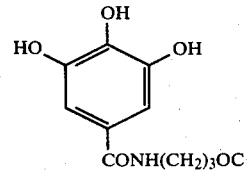

-continued

I-9

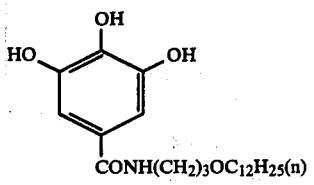

I-10

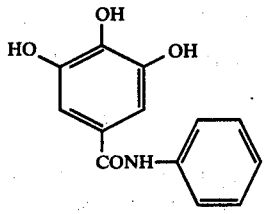

I-11

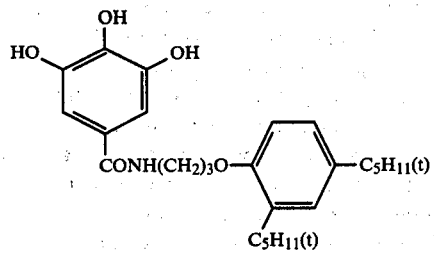

I-12

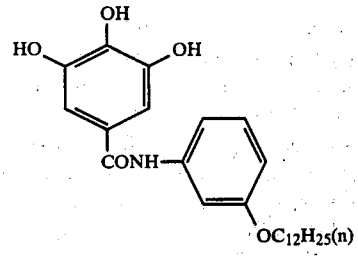

I-13

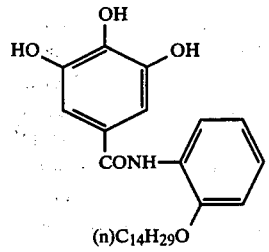

I-14

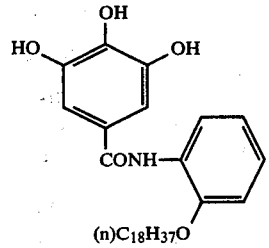

I-15

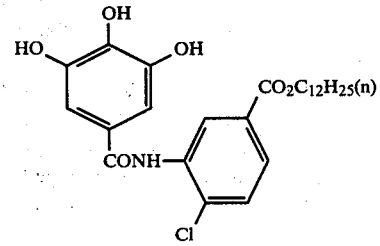

-continued
I-16
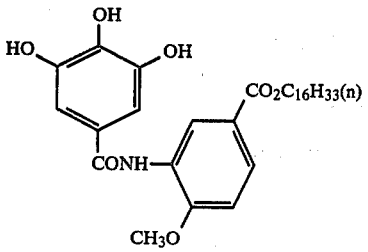
I-17
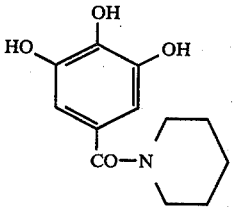
I-18
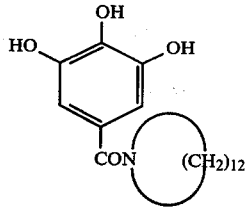
I-19
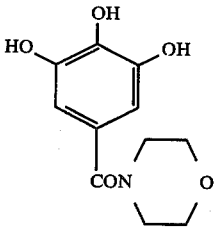
I-20
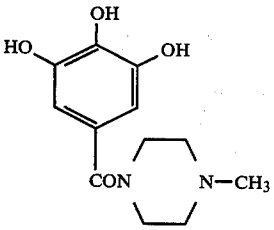
I-21
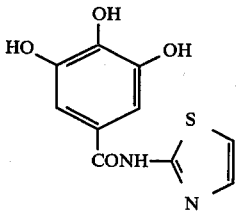
I-22
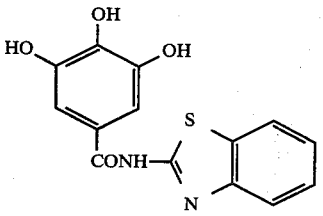
-continued
I-23
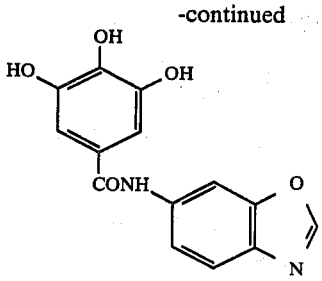
I-24
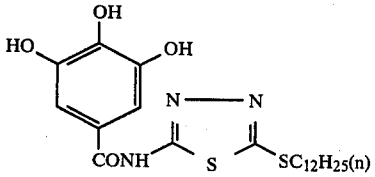
I-25
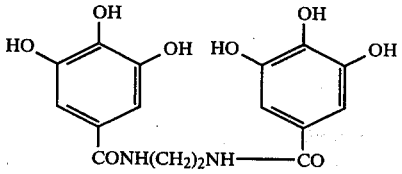
I-26
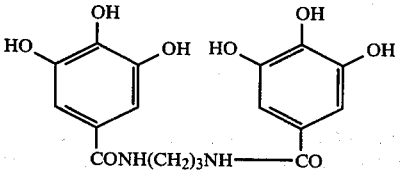
I-27
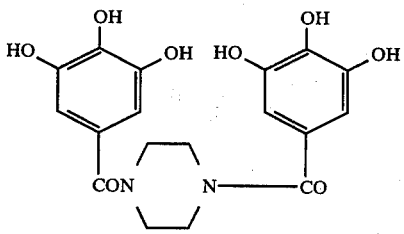
I-28
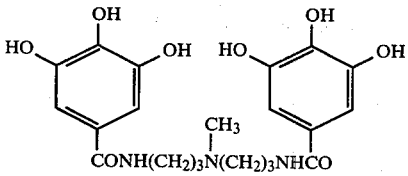
I-29
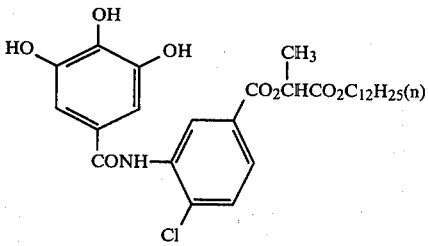
The term of high speed reactive couplers, which are employed in this invention, is given to those which quickly undergo coupling reactions with couplers such as those represented by the following general formulae (II) to (VI).

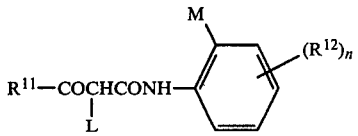

(II)

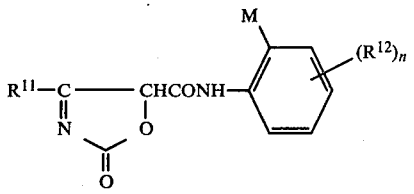

(III)

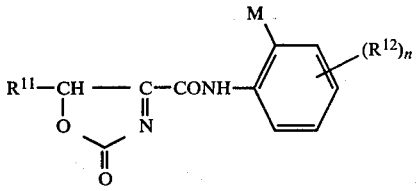

(IV)

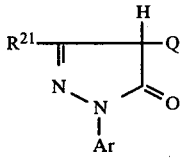

(V)

$(A)_m$—Z (VI)

Among those couplers, couplers represented by the general formulae (II), (V) and (VI) are more preferably used as the high speed reactive couplers.

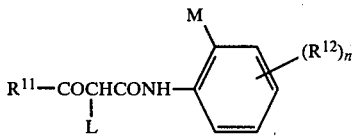

(II)

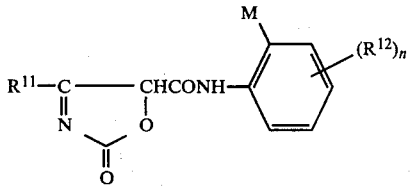

(III)

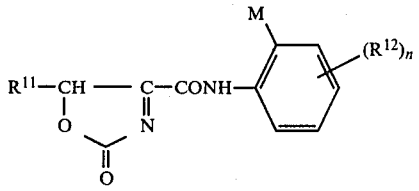

(IV)

In the general formulae (II), (III) and (IV) above, $R^{11}$ represents an alkyl group or an aryl group, each of which may be substituted; $R^{12}$ represents a substituent which can be substituted for a hydrogen atom attached to the benzene ring; and n represents 1 or 2. Therein, when n is 2, two $R^{12}$'s may be the same or different. M in the above-described formulae represents a halogen atom, an alkoxy group or an aryloxy group, and L therein represents a group capable of being released from the coupler upon the formation of a dye through the oxidative coupling with an aromatic primary amine developer.

More specifically, suitable examples of the alkyl group represented by $R^{11}$ include those which have 1 to 8 carbon atoms. Among these groups, those which have a branched chain, e.g., an isopropyl group, a tert-butyl group, a tert-amyl group and the like, are preferable. A tert-butyl group is particularly advantageous. Suitable examples of the aryl group represented by $R^{11}$ include phenyl and so on.

Substituents of the alkyl group and the aryl group represented by $R^{11}$ are not limited to any particular ones. However, specific examples include halogen atoms (e.g., fluorine, chlorine, bromine, iodine, etc.), alkyl groups (e.g., methyl, ethyl, t-butyl, etc.), aryl groups (e.g., phenyl, naphthyl, etc.), alkoxy groups (e.g., methoxy, ethoxy, etc.), aryloxy groups (e.g., phenoxy, etc.), alkylthio groups (e.g., methylthio, ethylthio, octylthio, etc.), arylthio groups (e.g., phenylthio, etc.), acylamino groups (e.g., acetamide, butyramide, benzamide, etc.), carbamoyl groups (e.g., N-methylcarbamoyl, N-phenylcarbamoyl, etc.), acyl groups (e.g., acetyl, benzoyl, etc.), sulfonamido groups (e.g., methanesulfonamide, benzenesulfonamide, etc.), a sulfamoyl group, a nitrile group, acyloxy groups (e.g., acetoxy, benzoxy, etc.), alkyloxycarbonyl groups (e.g., methyloxycarbonyl, etc.) and so on.

Specific examples of $R^{12}$ include halogen atoms (e.g., fluorine, chlorine, bromine, iodine, etc.),

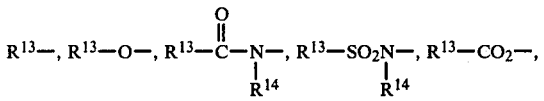

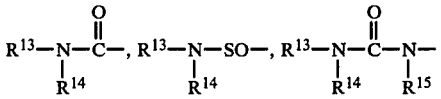

and so on. Therein, $R^{13}$, $R^{14}$ and $R^{15}$ may be the same or different, and they each represents a hydrogen atom, and alkyl group, an aryl group or a heterocyclic residue, which groups each may have a certain substituents. Preferable examples of them include alkyl groups and aryl groups which may have certain substituents. Specific examples of such substituents include the same groups as described in $R^{11}$.

Specific examples of the halogen atom represented by M include fluorine, chlorine, bromine and iodine. Among such atoms, fluorine and chlorine are more favorable. Suitable examples of the alkoxy group represented by M include those which contain 1 to 18 carbon atoms, e.g., methoxy, ethoxy, cetyloxy, etc. In such groups, methoxy is particularly suitable. Suitable examples of the aryloxy group represented by M include phenoxy and naphthyloxy.

Specific examples of the group represented by L include halogen atoms (e.g., fluorine, chlorine, bromine, etc.), —$SR^{16}$ groups [wherein $R^{16}$ represents an alkyl group (e.g., methyl, ethyl, ethoxyethyl, ethoxycarbonylmethyl, etc.), an aryl group (e.g., phenyl, 2-methoxyphenyl, etc.), a heterocyclic residue (e.g., benzoxazolyl, 1-phenyl-5-tetrazolyl, etc.) or an acyl group (e.g., ethoxycarbonyl, etc.)], —$OR^{17}$ groups [wherein $R^{17}$ represents an alkyl group (e.g., carboxymethyl, N-(2-methoxyethyl)carbamoylmethyl, etc.), an aryl group (e.g., phenyl, 4-carboxyphenyl, 4-(4-benzyloxybenzenesulfonyl)phenyl, etc.), a heterocyclic residue (e.g., 1-phenyl-5-tetrazolyl, isoxazolyl, 4-pyridyl, etc.) or an acyl group (e.g., ethoxycarbonyl, N,N-diethylcarbamoyl, phenylsulfamoyl, N-phenylthiocarbamoyl, etc.)] and

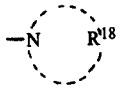

groups (wherein $R^{18}$ represents non-metal atoms necessary to form a 5- or 6-membered ring together with —N<, and constituent atoms of such a ring include C, N, O and/or S and, further, such a ring may have proper substituents).

Specific examples of the heterocyclic residue represented by

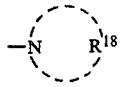

are illustrated below:

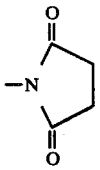

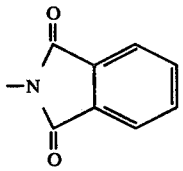

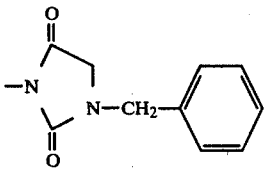

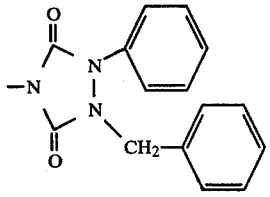

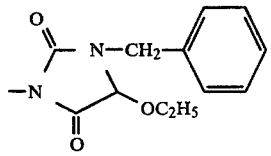

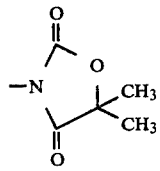

-continued

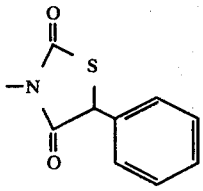

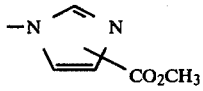

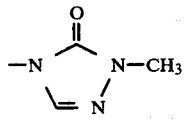

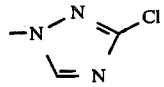

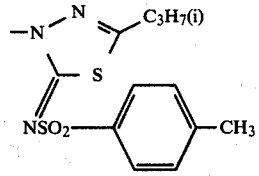

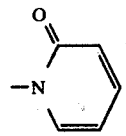

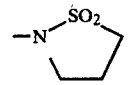

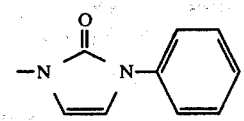

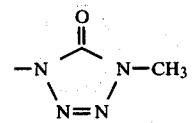

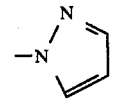

Specific examples of the high speed relative couplers represented by the general formulae (II) to (IV) are illustrated below. However, the high speed reactive couplers of these types which can be employed in this invention should not be construed as being limited to the following examples.

II-1
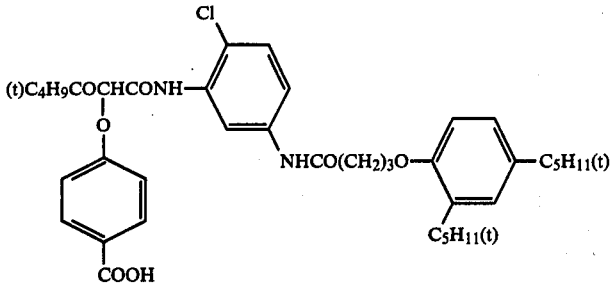
II-2
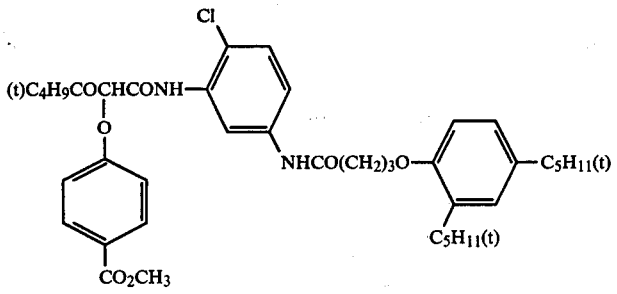
II-3
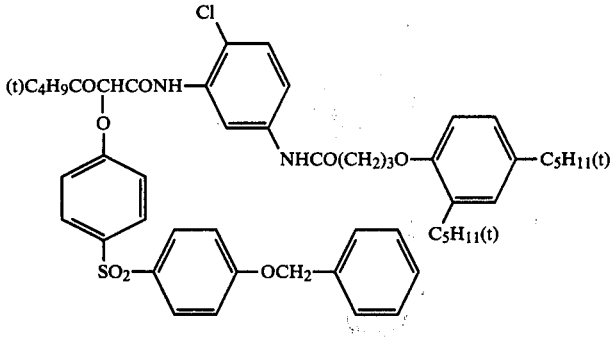
II-4
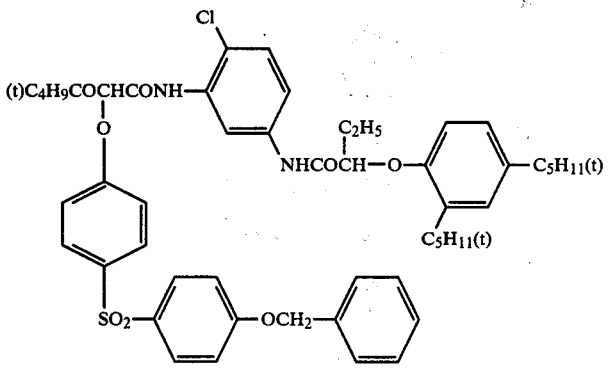
II-5
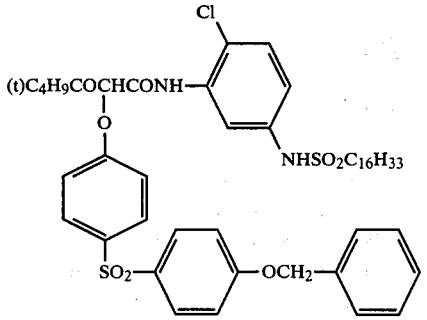

-continued
II-6
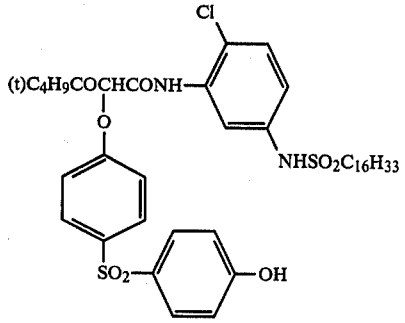
II-7
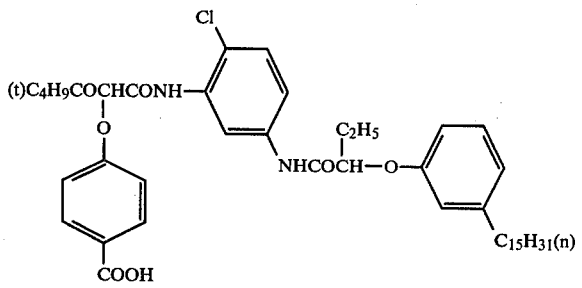
II-8
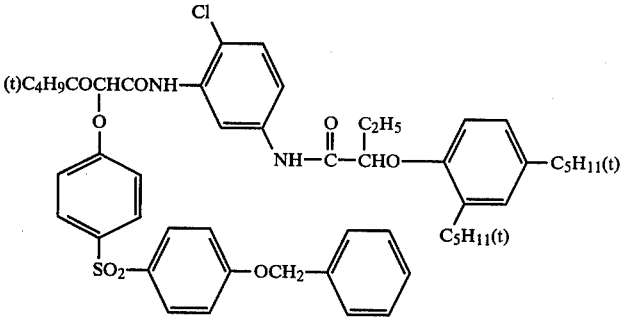
II-9
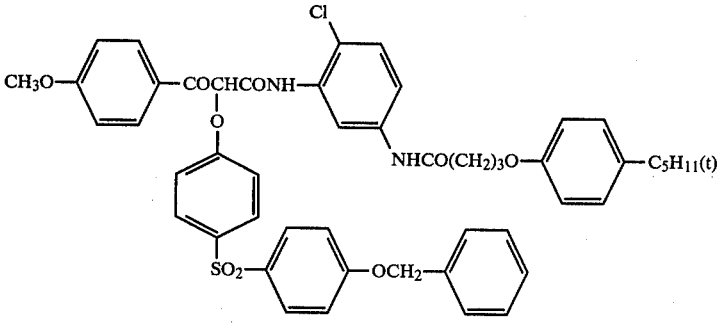
II-10
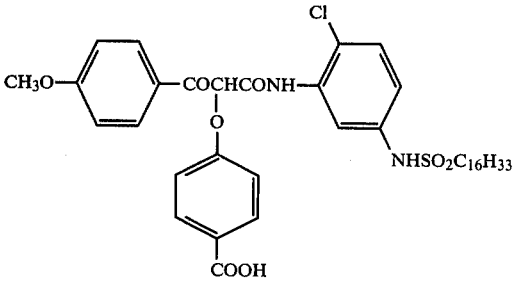

-continued
II-11
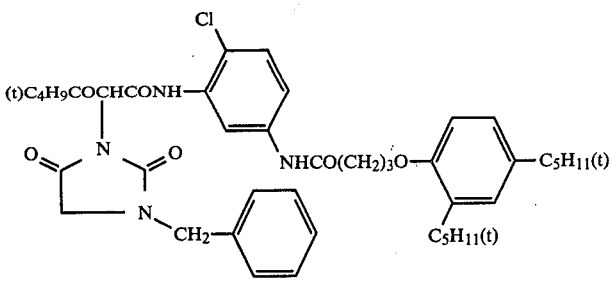
II-12
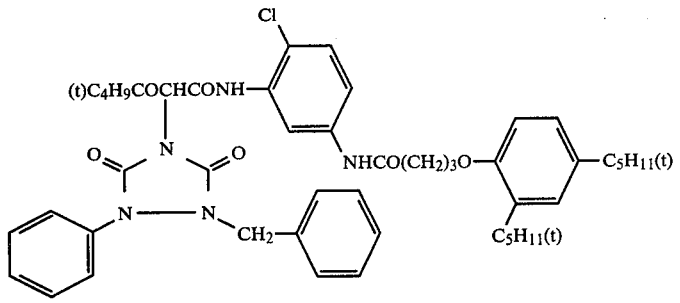
II-13
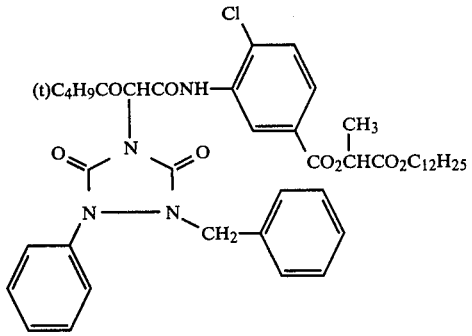
II-14
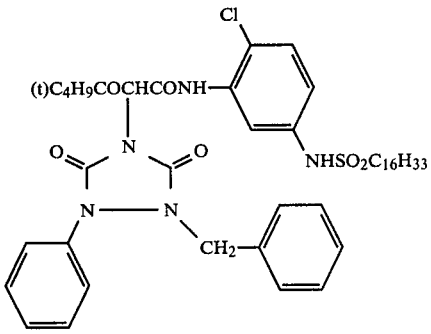
II-15
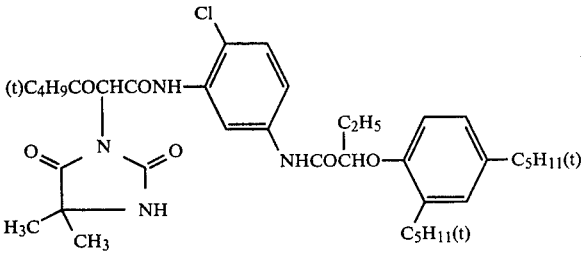

-continued
II-16
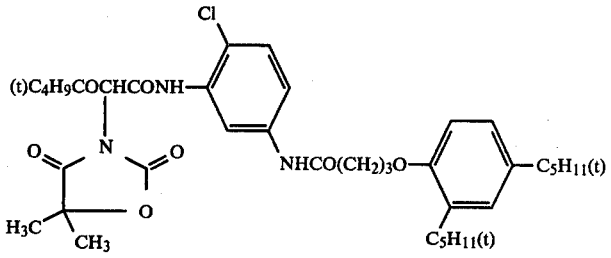
II-17
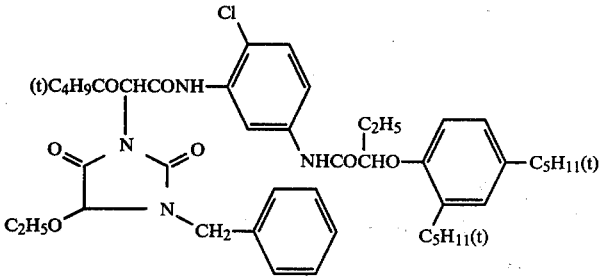
II-18
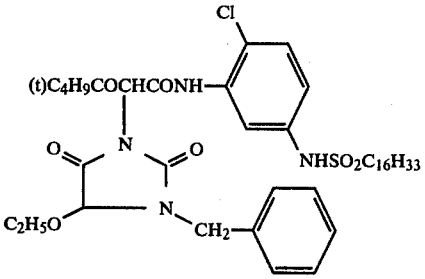
II-19
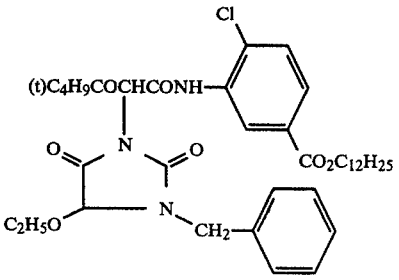
II-20
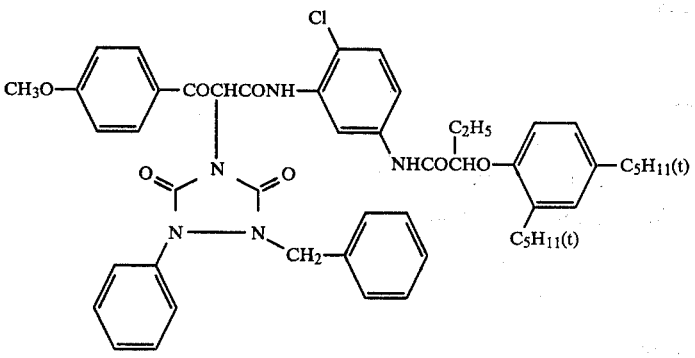

-continued
II-21
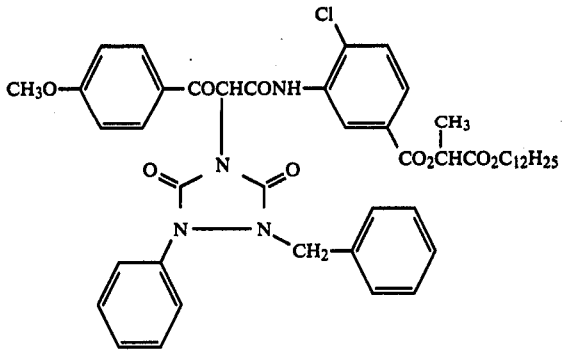
II-22
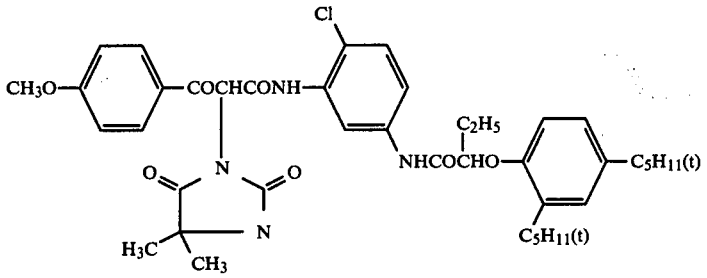
II-23
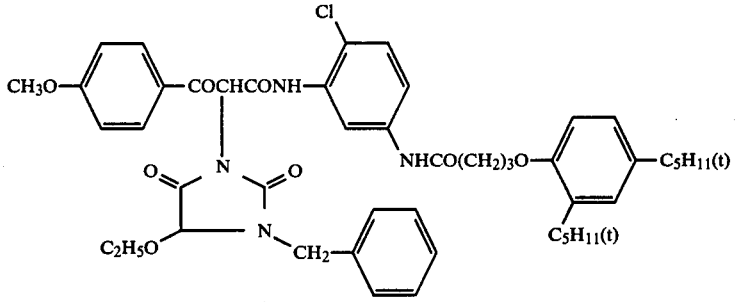
II-24
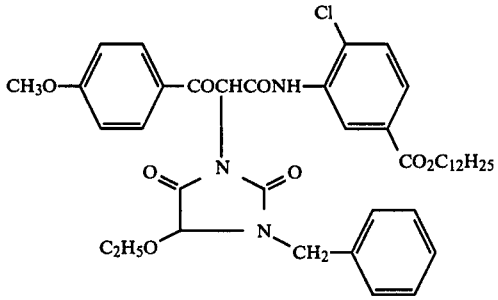
II-25
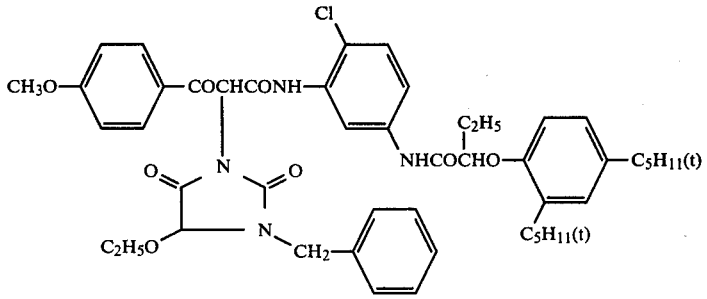

-continued
II-26
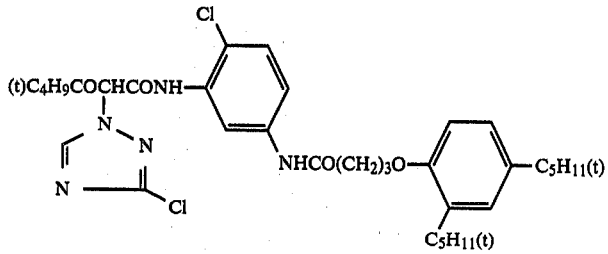
II-27
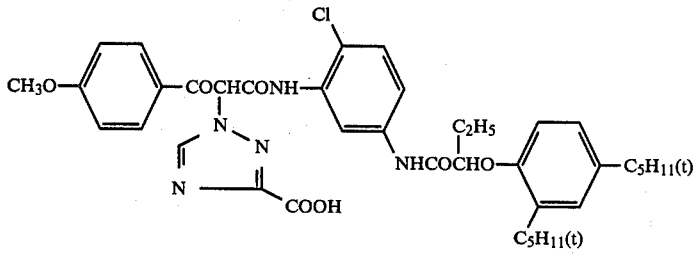
II-28
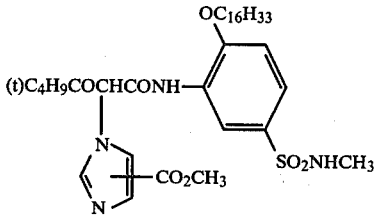
II-29
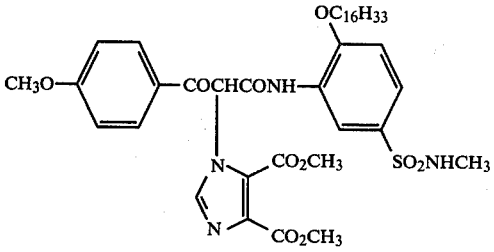
II-30
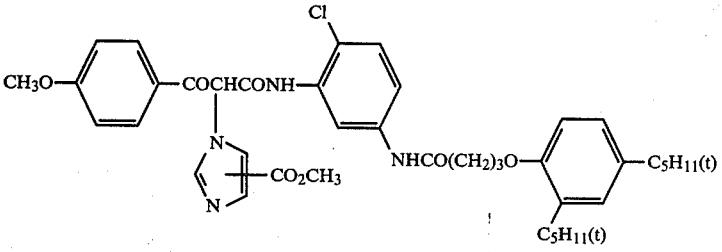
II-31
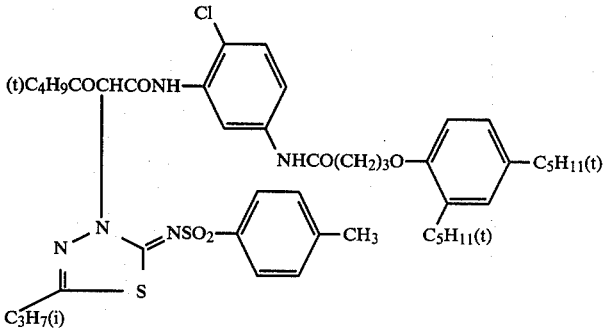

-continued
II-32
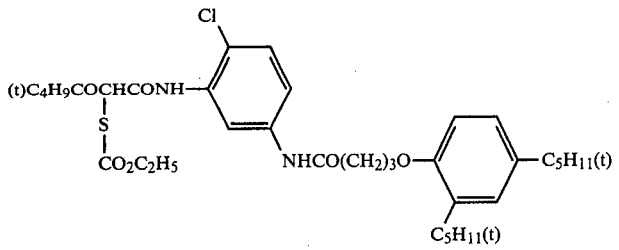
II-33
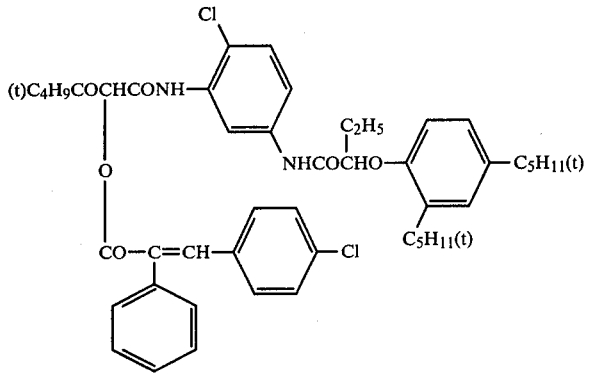
II-34
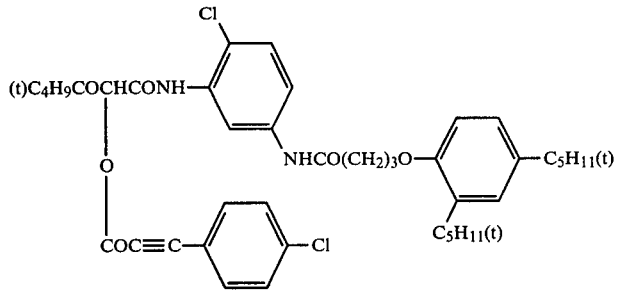
II-35
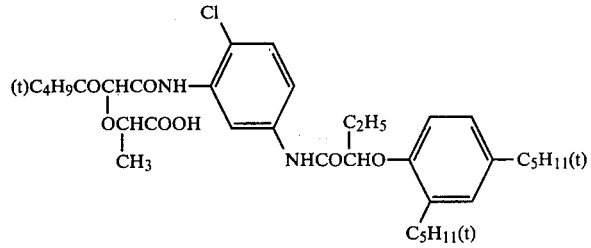
II-36
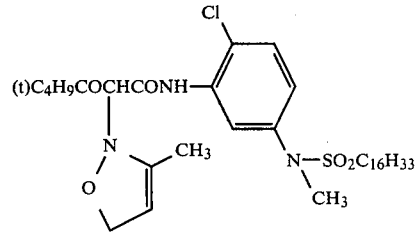
II-37
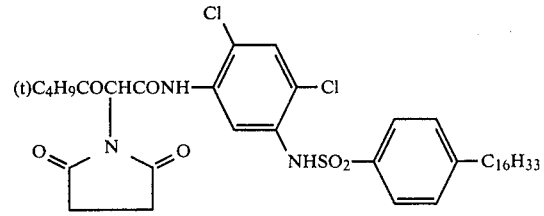

-continued
II-38
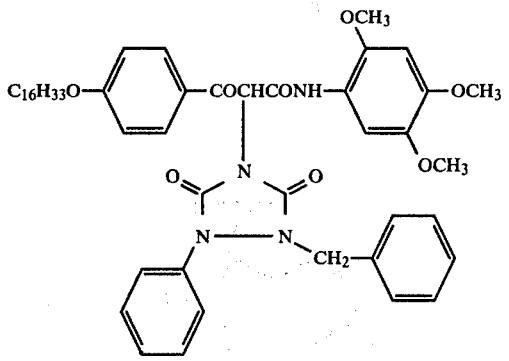
II-39
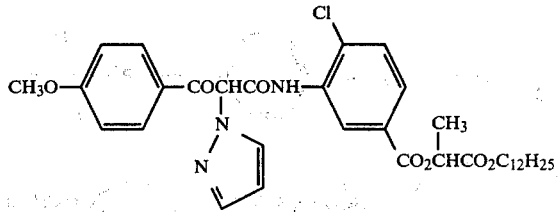
III-1
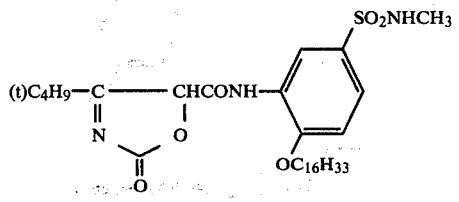
III-2
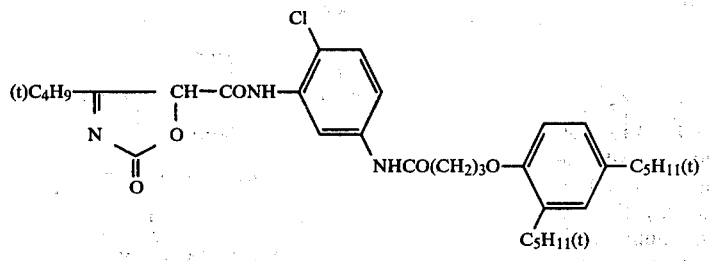
III-3
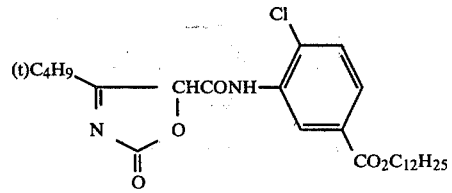
III-4
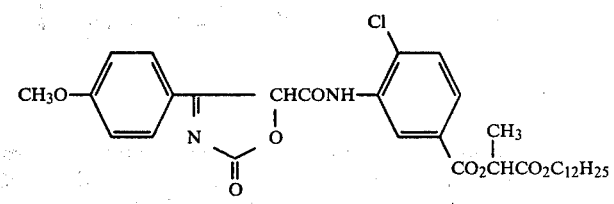
IV-1
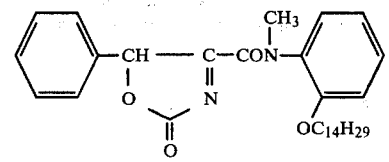

-continued (V)

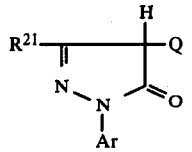

In the general formula (V) above, $R^{21}$ represents an amino group, an acylamino group or a ureido group; Q represents a group capable of being released from the coupler (V) upon the formation of a dye through the oxidative coupling with an aromatic primary amine developer; and Ar represents a phenyl group which may have one or more of a substituent, with specific examples of the substituent including halogen atoms, alkyl groups, alkoxy groups, aryloxy groups, alkoxycarbonyl groups, a cyano group, a carbamoyl group, a sulfamoyl group, a sulfonyl group and acylamino groups.

The substituent groups in the general formula (V) are described in detail below.

Suitable examples of the amino group represented by $R^{21}$ include anilino, 2-chloroanilino, 2,4-dichloroanilino, 2,5-dichloroanilino, 2,4,5-trichloroanilino, 2-chloro-5-tetradecanamidoanilino, 2-chloro-5-(3-octadecenylsuccinimido)anilino, 2-chloro-5-tetradecyloxycarbonylanilino, 2-chloro-5-(N-tetradecylsulfamoyl)anilino, 2,4-dichloro-5-tetradecyloxyanilino, 2-chloro-5-(tetradecyloxycarbonylamino)anilino, 2-chloro-5-octadecylthioanilino, 2-chloro-5-(N-tetradecylcarbamoyl)anilino, 2-chloro-5-[α-(3-tert-butyl-4-hydroxy)tetradecanamido]anilino, dimethylamino, diethylamino, dioctylamino, pyrrolidino and so on.

Suitable examples of the acylamino group represented by $R^{21}$ include acetamido, benzamido, 3-[α-(2,4-di-tert-amylphenoxy)butanamido]benzamido, 3-[α-(2,4-di-tert-amylphenoxy)acetamido]benzamido, 3-[α-(3-pentadecylphenoxy)butanamido]benzamido, α-(2,4-di-tert-amylphenoxy)butanamido, α-(3-pentadecylphenoxy)butanamido, hexadecanamido, isostearoylamino, 3-(3-octadecenylsuccinimido)benzamido, pivaloylamino and so on.

Suitable examples of the ureido group represented by $R^{21}$ include 3-[(2,4-di-tert-amylphenoxy)acetamido]-phenylureido, phenylureido, methylureido, octadecylureido, 3-tetradecanamidophenylureido, N,N-dioctylureido and so on.

Specific examples of Q in the general formula (V) include halogen atoms (e.g., fluorine, chlorine, bromine, etc.), —SCN, —NCS, $R^{22}SO_2NH$—

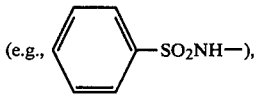

$R^{22}CONH$— (e.g., $CF_3CONH$—, $Cl_3CCONH$—, etc.), $R^{22}OCONH$— (e.g., $CH_3OCONH$—), $R^{22}O$—

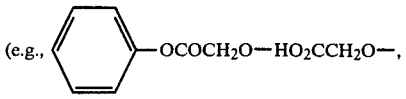

-continued

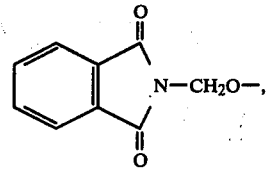

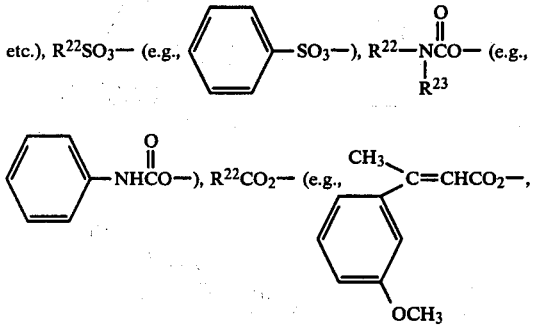

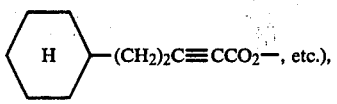

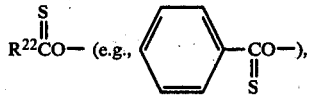

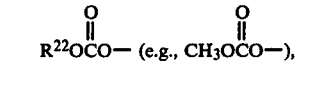

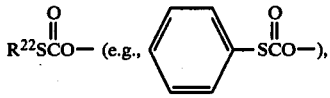

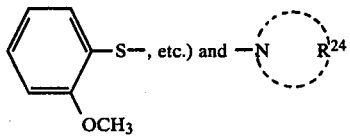

(wherein $R^{24}$ represents non-metal atoms necessary to form a 5- or 6-membered ring together with —N< and that, its constituent atoms include C, N, O and/or S, and which ring may have an appropriate substituent).

Suitable examples of the ring residue represented by

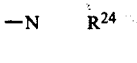

include

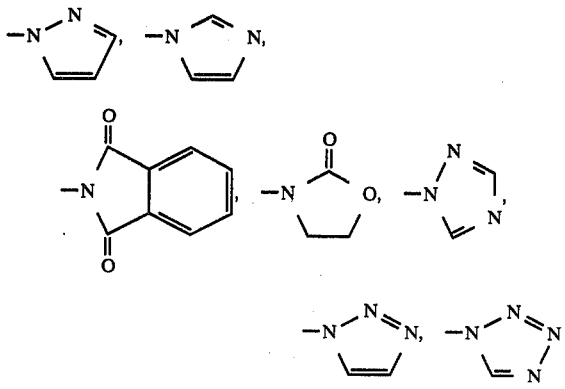

and so on. Suitable examples of the substituent which may be attached to such ring residues include alkyl groups, alkenyl groups, alicyclic hydrocarbon residues, aralkyl groups, aryl groups, heterocyclic residues, alkoxy groups, alkoxycarbonyl groups, aryloxy groups, alkylthio groups, carboxy groups, acylamino groups, diacylamino groups, ureido groups, alkoxycarbonylamino groups, amino groups, acyl groups, a sulfonamido group, a carbamoyl group, a sulfamoyl group, a cyano group, acyloxy groups, a sulfonyl group, halogen atoms, a sulfo group and so on.

Therein, $R^{22}$ and $R^{23}$ may be either the same or different, and they each represents an aliphatic hydrocarbon, an aromatic hydrocarbon or a heterocyclic ring residue. $R^{22}$ and $R^{23}$ may have proper substituents, and $R^{23}$ may be a hydrogen atom.

The aliphatic hydrocarbon residue represented by $R^{22}$ or $R^{23}$ includes straight chain or branched chain alkyl groups, alkenyl groups, alkynyl groups and alicyclic hydrocarbon residues.

Specific examples of the alkyl group represented by $R^{22}$ or $R^{23}$ include those having 1 to 32, preferably 1 to 20, carbon atoms, such as methyl, ethyl, propyl, butyl, octyl, octadecyl, isopropyl and so on. Specific examples of the alkenyl group represented by $R^{22}$ or $R^{23}$ include those having 2 to 32, preferably 3 to 20, carbon atoms, such as allyl, butenyl and so on. Specific examples of the alkynyl group represented by $R^{22}$ or $R^{23}$ include those having 2 to 32, preferably 2 to 20, carbon atoms, such as ethynyl, propargyl and so on. Specific examples of the alicyclic hydrocarbon residue represented by $R^{22}$ or $R^{23}$ include those having 3 to 32, preferably 5 to 20, carbon atoms, such as cyclopentyl, cyclohexyl, 10-camphanyl and so on.

Specific examples of the aromatic hydrocarbon residue represented by $R^{22}$ or $R^{23}$ include a phenyl group, a naphthyl group and so on.

The heterocyclic group represented by $R^{22}$ or $R^{23}$ is a 5- or 6-membered ring residue which is constituted with carbon atoms and at least one or more hetero atoms selected from the group consisting of a nitrogen atom, an oxygen atom and a sulfur atom and, further, may be condensed with a benzene ring, with specific examples including pyridyl, pyrrolyl, pyrazolyl, triazolyl, triazolidyl, imidazolyl, tetrazolyl, thiazolyl, oxazolyl, thiadiazolyl, oxadiazolyl, quinolinyl, benzothiazolyl, benzoxazolyl, benzimidazolyl, benzotriazolyl and so on.

Specific examples of the substituents which the groups represented by $R^{22}$ or $R^{23}$ may have include alkyl groups (e.g., methyl, ethyl, t-octyl, etc.), aryl groups (e.g., phenyl, naphthyl, etc.), a nitro group, a hydroxyl group, a cyano group, a sulfo group, alkoxy groups (e.g., methoxy, ethoxy, butyloxy, methoxyethoxy, etc.), aryloxy groups (e.g., phenoxy, naphthyloxy, etc.), a carboxyl group, acyloxy groups (e.g., acetoxy, benzoxy, etc.), acylamino groups (e.g., acetylamino, benzoylamino, etc.), sulfonamido groups (e.g., methanesulfonamido, benzenesulfonamido, etc.), sulfamoyl groups (e.g., methylsulfamoyl, phenylsulfamoyl, etc.), halogen atoms (e.g., fluorine, chlorine, bromine, etc.), carbamoyl groups (e.g., N-methylcarbamoyl, N-2-methoxyethylcarba-2-moyl, N-phenylcarbamoyl, etc.), alkoxycarbonyl groups (e.g., methoxycarbonyl, ethoxycarbonyl, etc.), acyl groups (e.g., acetyl, benzoyl, etc.), sulfonyl groups (e.g., methylsulfonyl, phenylsulfonyl, etc.), sulfinyl groups (e.g., methylsulfinyl, phenylsulfinyl, etc.), heterocyclic groups (e.g., morpholino, pyrazolyl, triazolyl, tetrazolyl, imidazolyl, pyridyl, benzotriazolyl, benzimidazolyl, etc.), amino groups (e.g., non-substituted amino, methylamino, ethylamino, etc.), alkylthio groups (e.g., methylthio, ethylthio, carboxymethylthio, etc.), arylthio groups (e.g., phenylthio, etc.) and so on. These substituents may be further substituted with one of these substituents.

Specific examples of the high speed reactive coupler represented by the general formula (V) are illustrated below. However, the high speed reactive couplers of this type which can be employed in this invention should not be construed as being limited to the following examples.

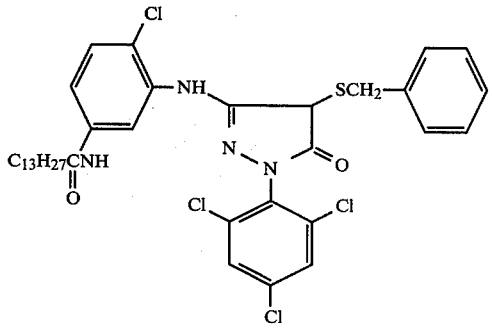

V-1

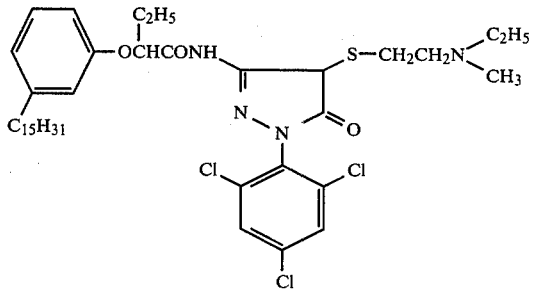

V-2

-continued
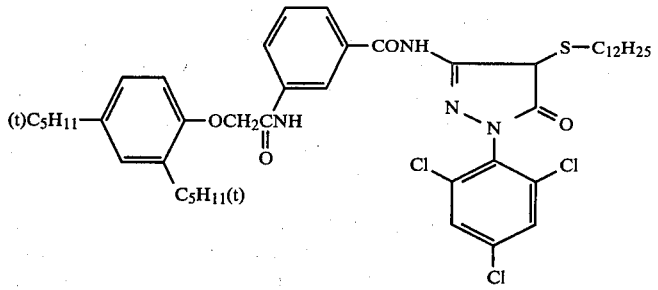
V-3
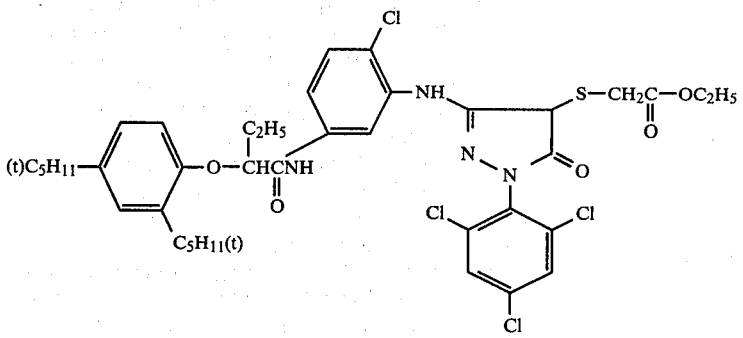
V-4
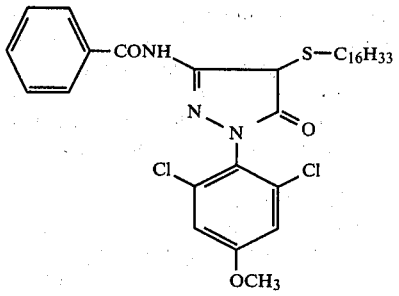
V-5
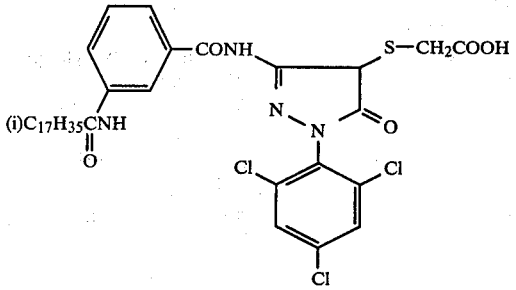
V-6
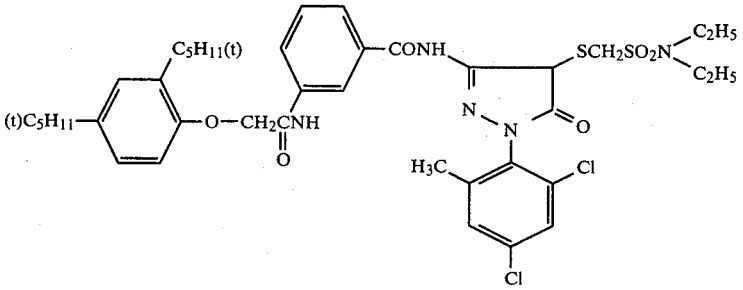
V-7

-continued
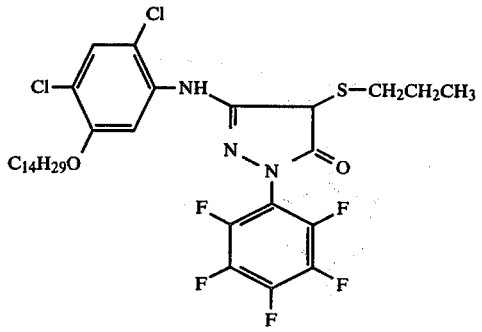
V-8
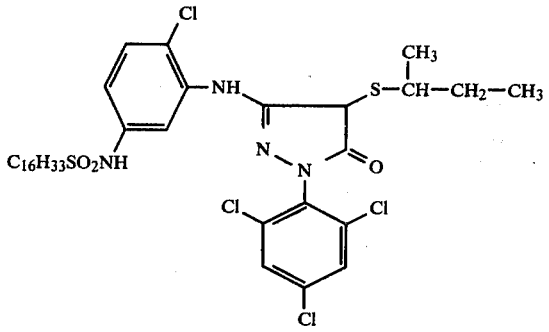
V-9
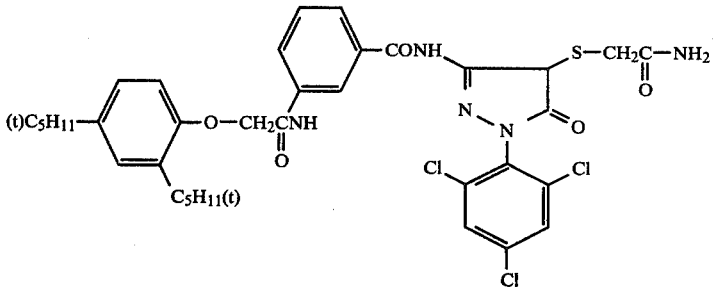
V-10
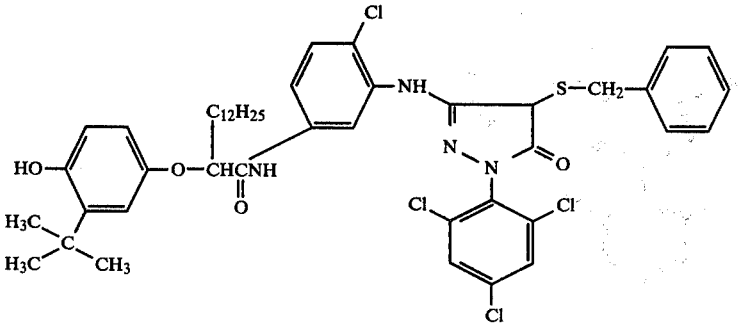
V-11
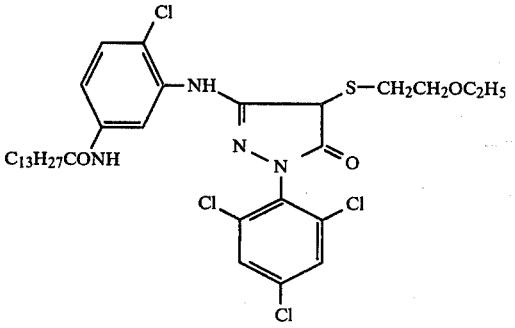
V-12
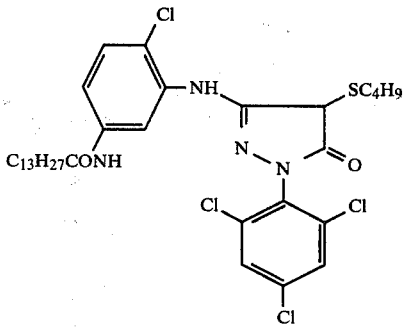
V-13

-continued
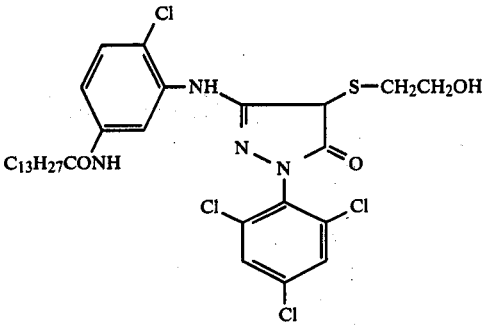
V-14
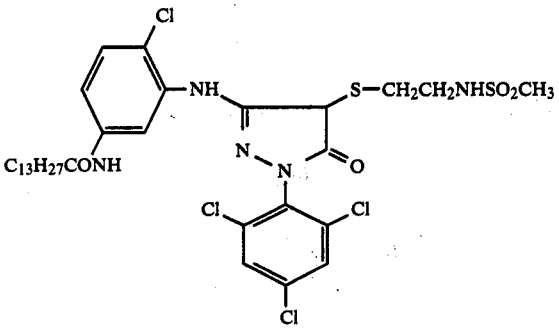
V-15
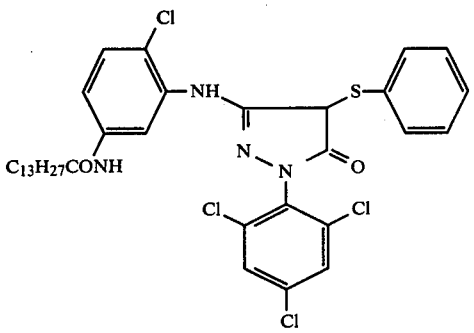
V-16
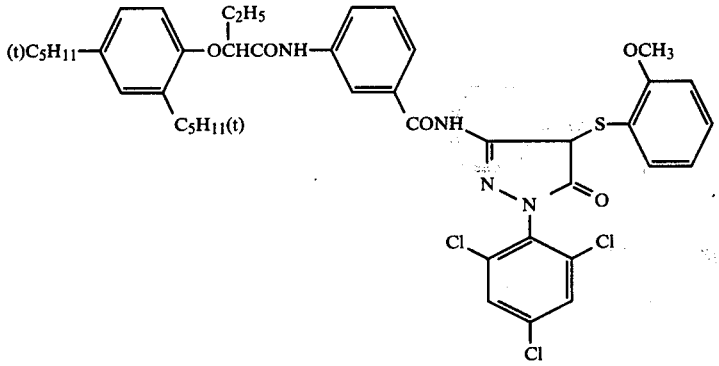
V-17
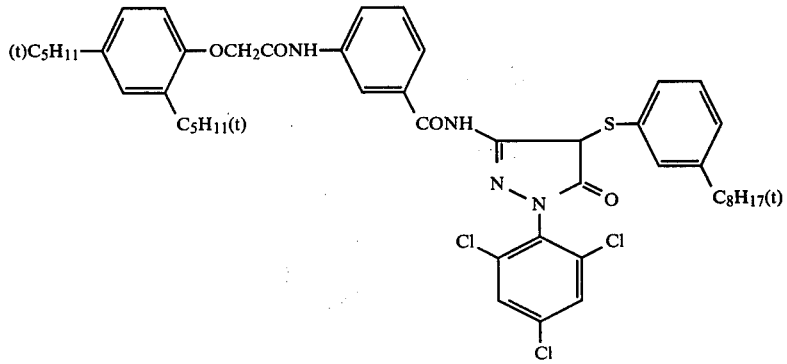
V-18

-continued
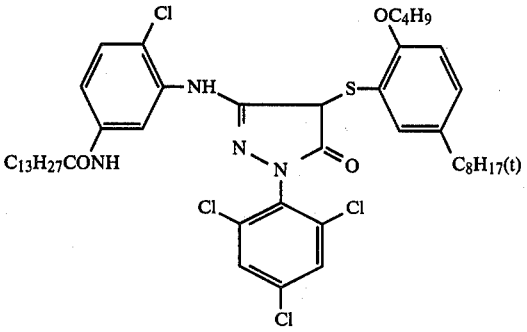
V-19
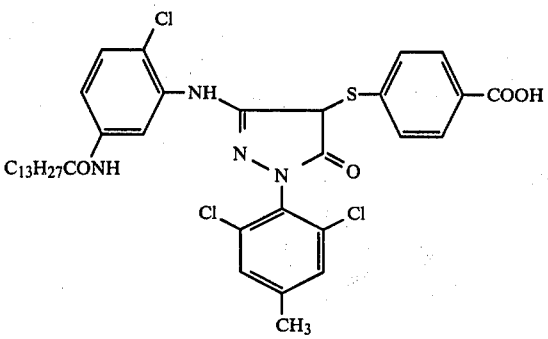
V-20
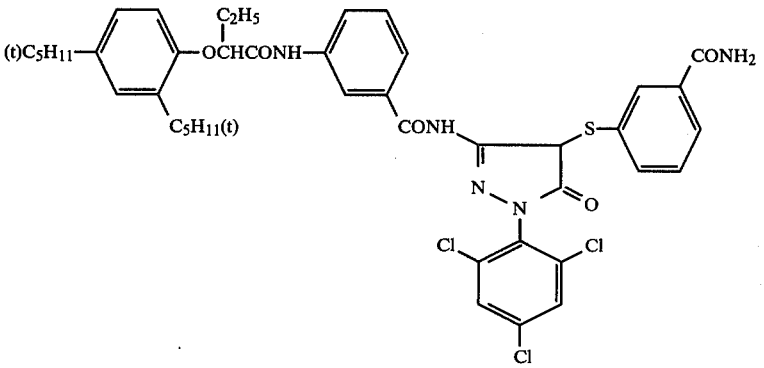
V-21
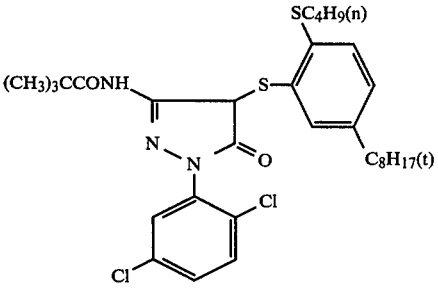
V-22
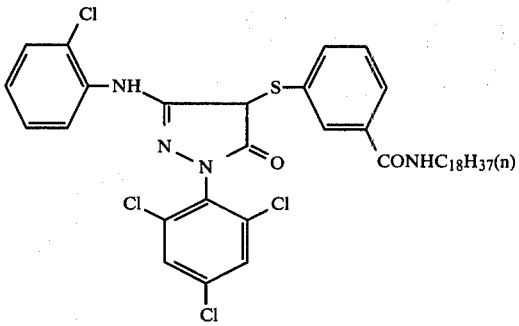
V-23
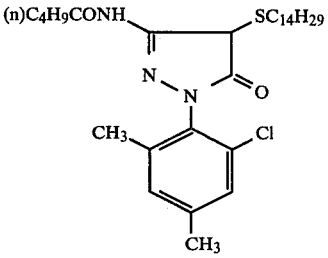
V-24
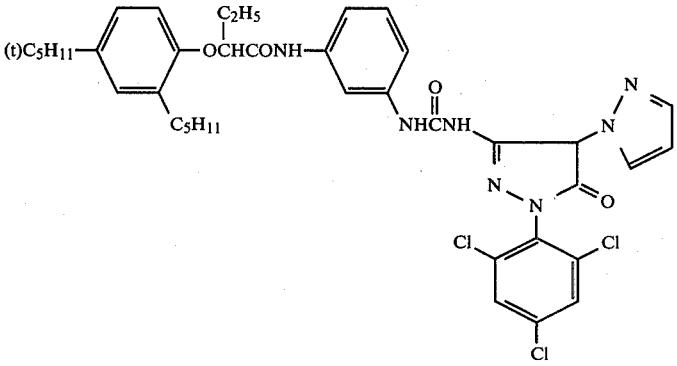
V-25

-continued
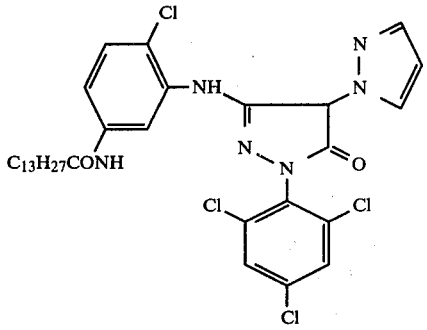
V-26
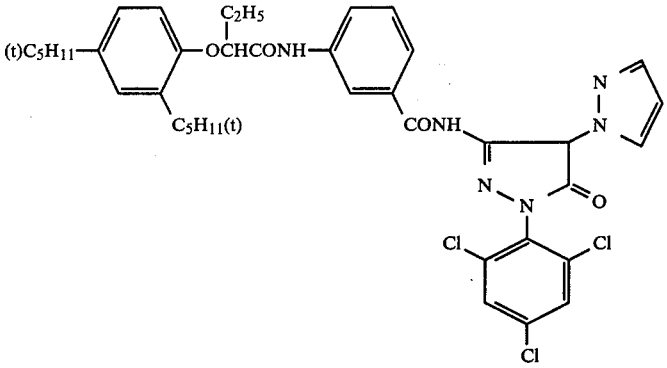
V-27
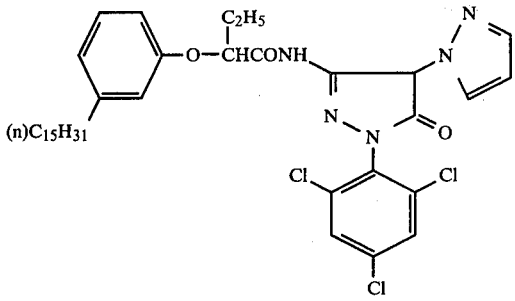
V-28
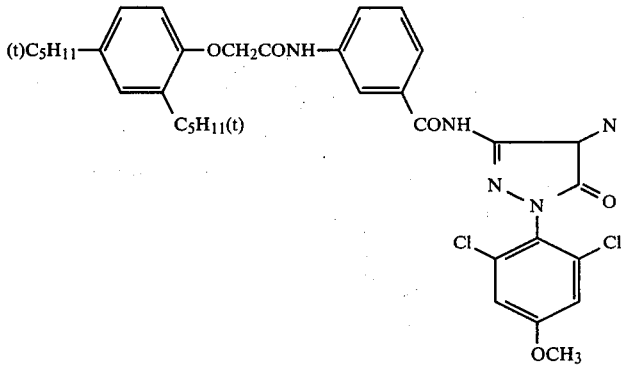
V-29
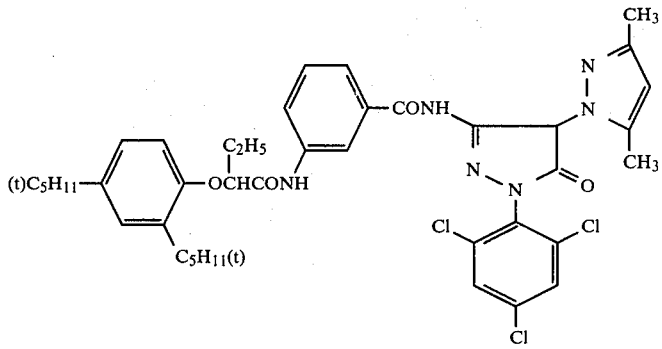
V-30

-continued
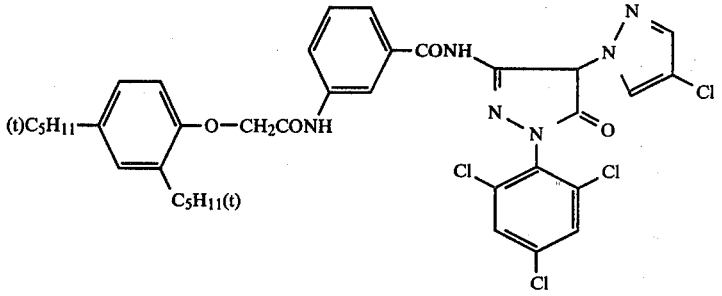
V-31
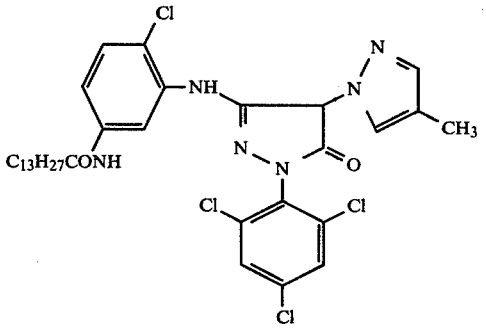
V-32
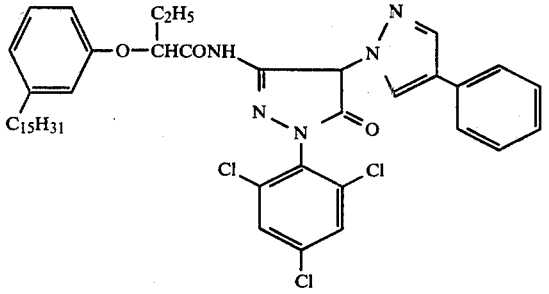
V-33
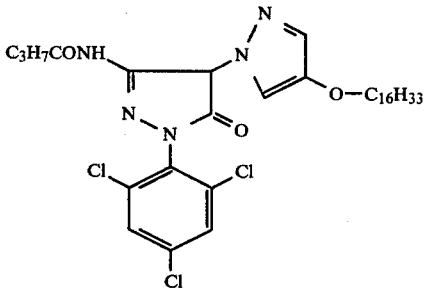
V-34
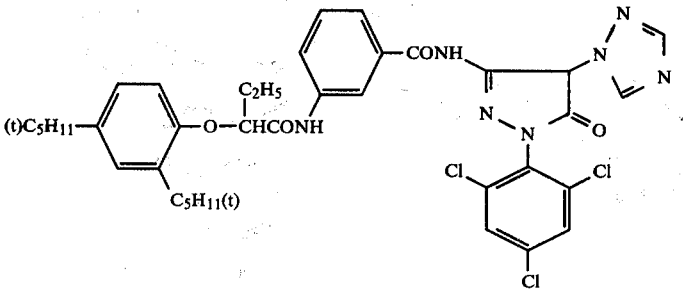
V-35
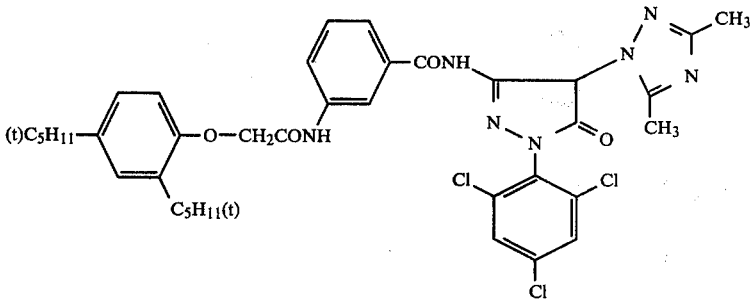
V-36

-continued
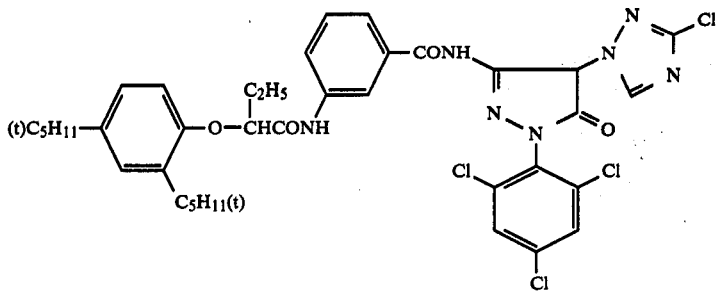
V-37
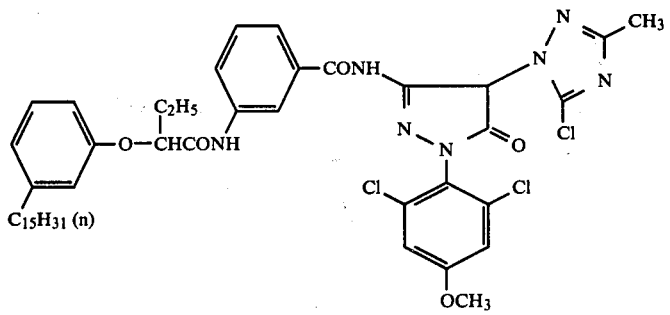
V-38
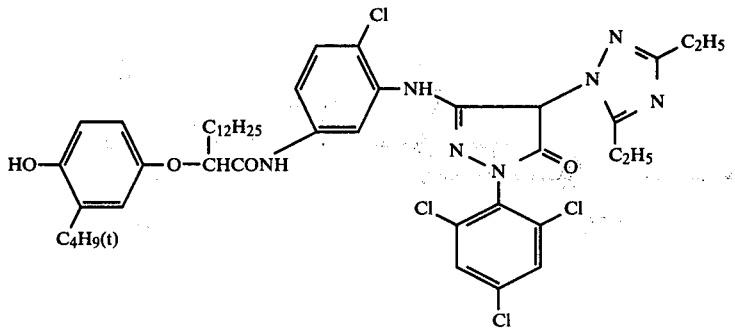
V-39
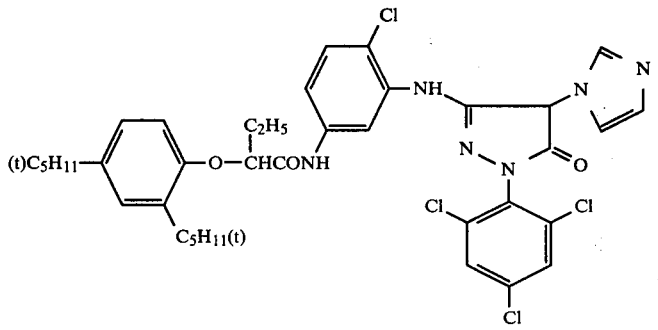
V-40

-continued
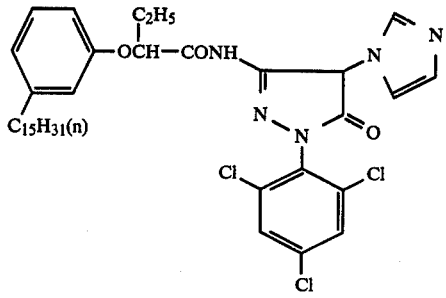
V-41
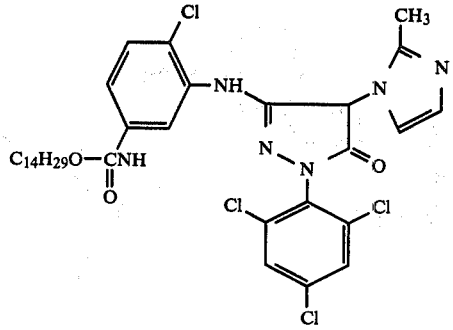
V-42
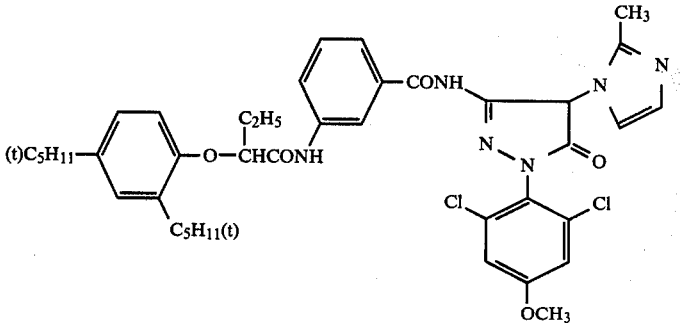
V-43
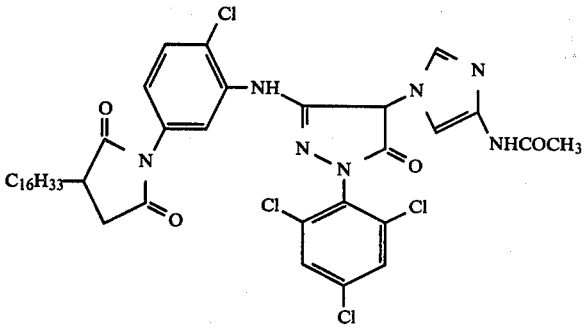
V-44
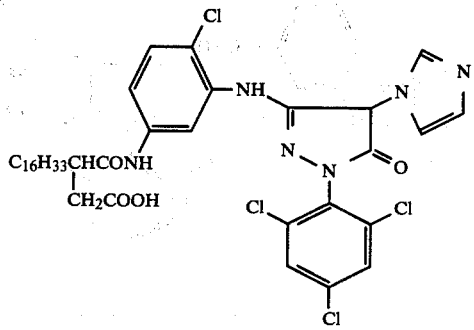
V-45
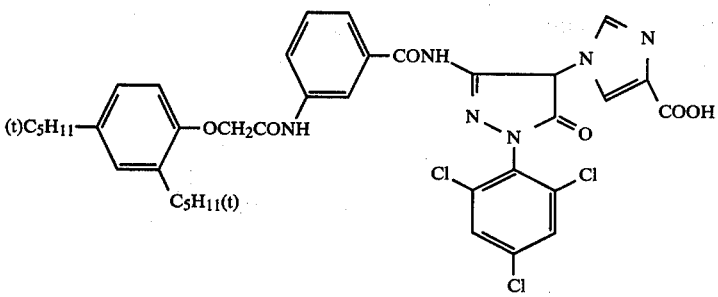
V-46

-continued
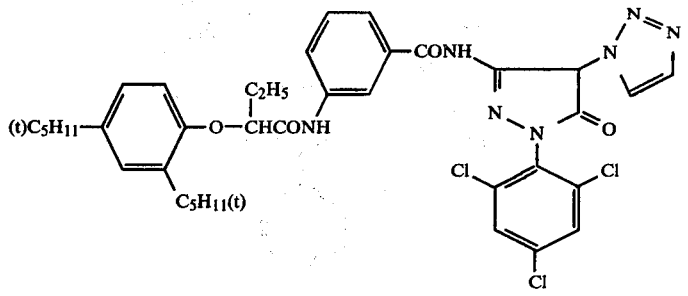
V-47
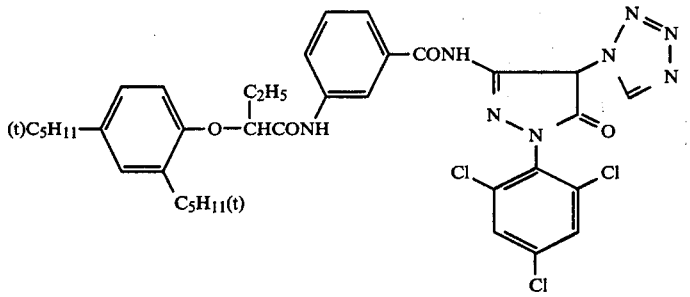
V-48
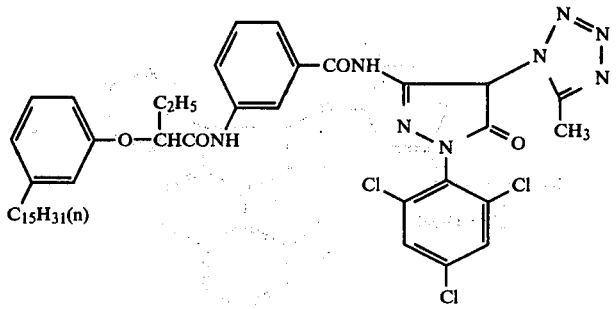
V-49
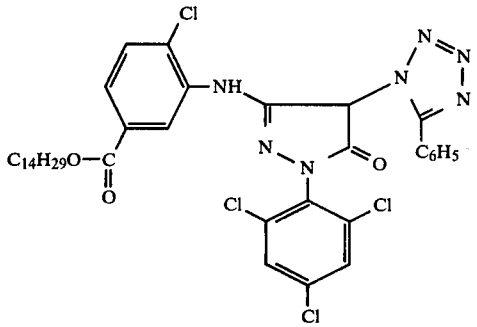
V-50
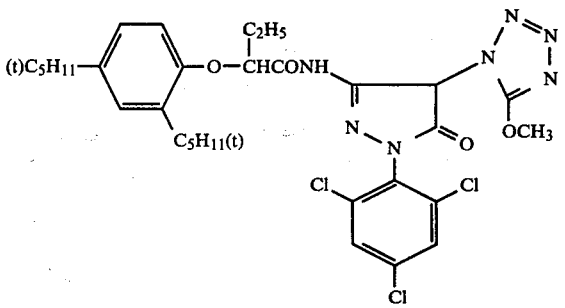
V-51

-continued
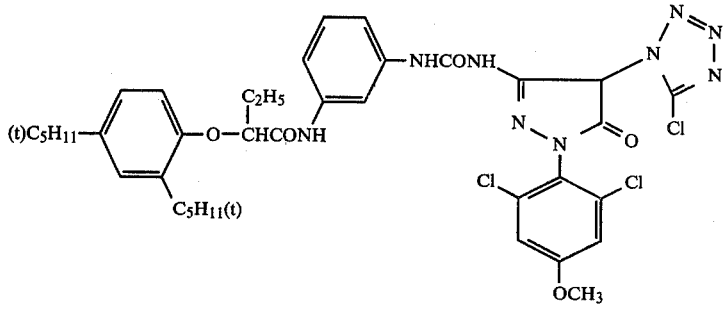
V-52
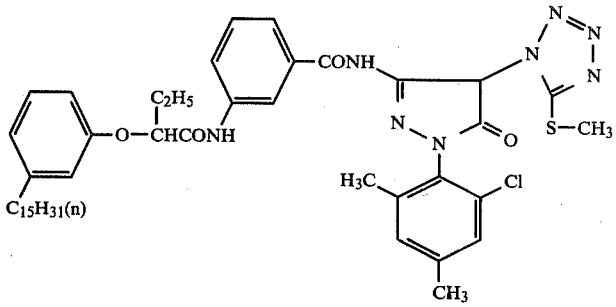
V-53
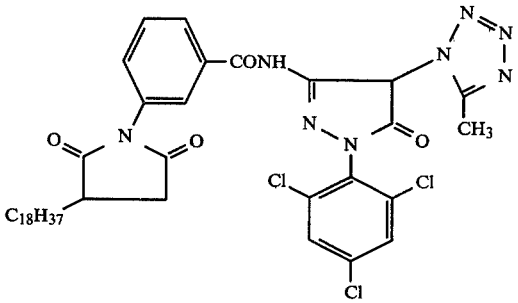
V-54
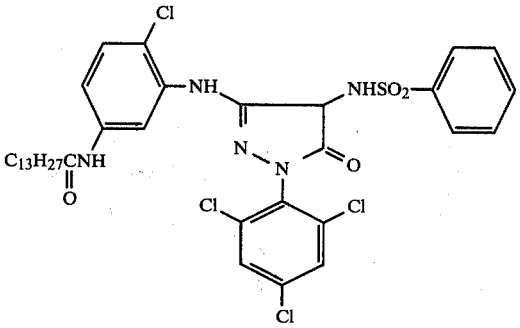
V-55
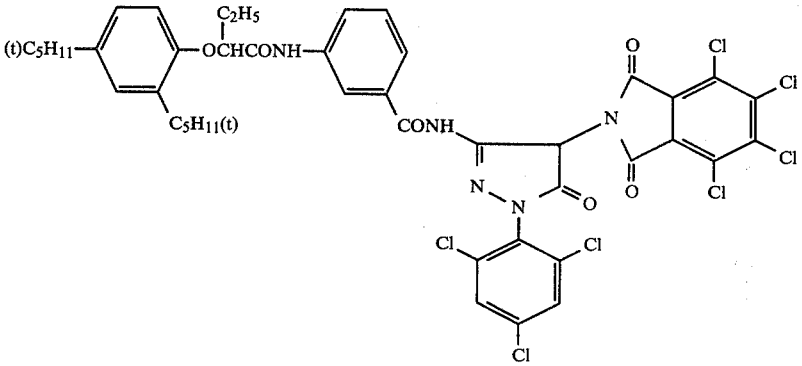
V-56

-continued
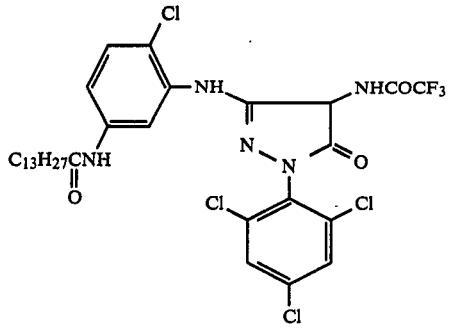
V-57
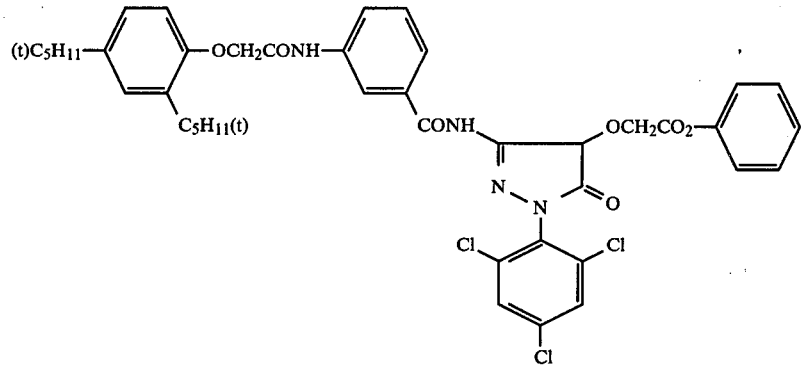
V-58
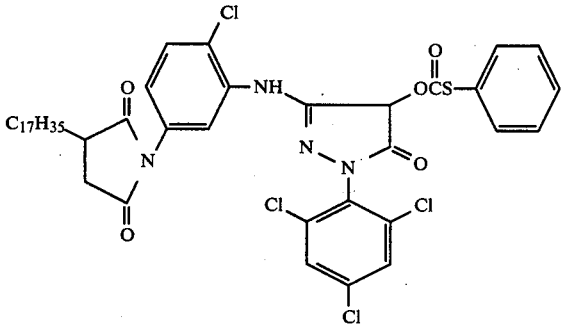
V-59
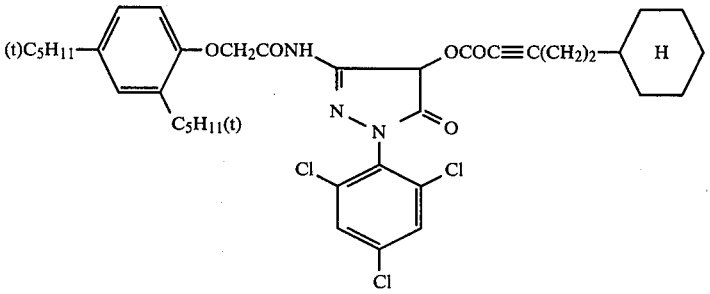
V-60

-continued

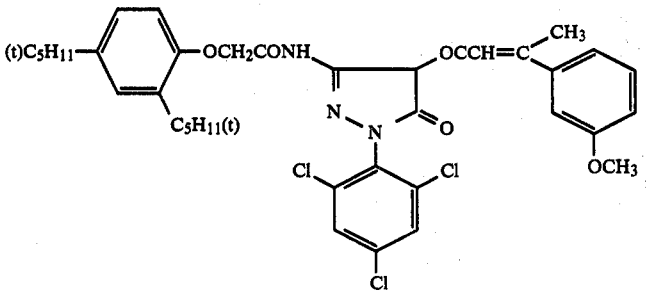

V-61

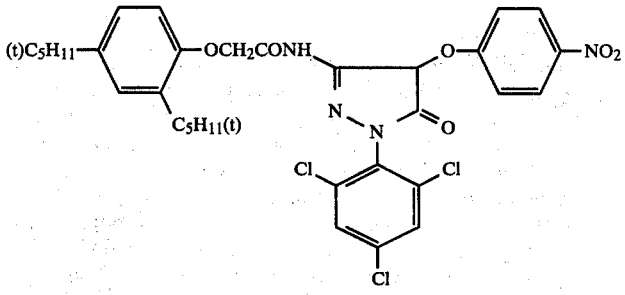

V-62

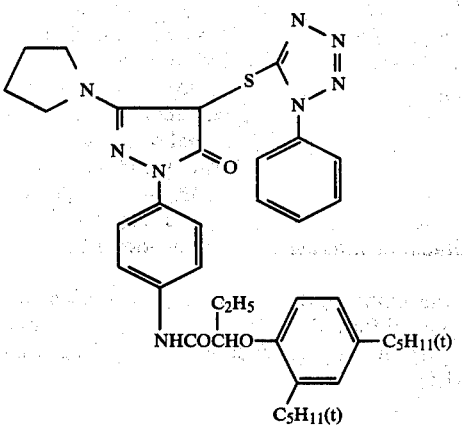

V-63

$(A)_m$—Z (VI)

In the general formula (VI) above, A represents an image forming coupler residue which has a naphthol or a phenol nucleus, m represents 1 or 2, and Z represents a group which is attached to the coupling site of the above-described coupler residue and released from the coupler (VI) when a dye is formed through the oxidative coupling reaction with an aromatic primary amine developer, with specific examples including halogen atoms (e.g., F, Cl, etc.), —SCN, —NCS, —$NHSO_2R^{31}$, —$NHCOR^{31}$,

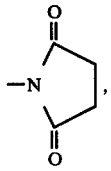

—$OR^{31}$, —$OSO_2R^{31}$, —$OCONR^{31}R^{32}$, —$OCOR^{31}$, —$OCSR^{31}$, —OCOCO—$R^{31}$, —$OCSNR^{31}R^{32}$, —O-$COOR^{31}$, —$OCOSR^{31}$ and —$SR^{31}$. Therein, when m represents 2, Z represents the divalent group corresponding to one of the above-described monovalent group. $R^{31}$ and $R^{32}$ therein (which may be the same or different), respectively, represent aliphatic groups, aromatic groups and heterocyclic groups, which each may have a proper substituent. $R^{32}$ may represent a hydrogen atom.

Suitable examples of the aliphatic groups represented by $R^{31}$ or $R^{32}$ include straight or branched chain alkyl groups, alkenyl groups, alkynyl groups and alicyclic hydrocarbon residues.

Specific examples of the alkyl groups represented by $R^{31}$ or $R^{32}$ include those having 1 to 32, preferably 1 to 20, carbon atoms, such as methyl, ethyl, propyl, butyl, octyl, octadecyl, isopropyl, etc. Specific examples of the alkenyl group represented by $R^{31}$ or $R^{32}$ include those having 2 to 32, preferably 3 to 20, carbon atoms, such as allyl, butenyl, etc. Specific examples of the alkynyl group represented by $R^{31}$ or $R^{32}$ include those having 2 to 32, preferably 2 to 20, carbon atoms, such as ethynyl, propargyl, etc. Specific examples of the alicyclic hydrocarbon residue represented by $R^{31}$ or $R^{32}$ include those having 3 to 32, preferably 5 to 20, carbon atoms, such as cyclopentyl, cyclohexyl, 10-camphanyl, etc.

Specific examples of the aromatic group represented by $R^{31}$ or $R^{32}$ include phenyl, naphthyl and the like.

The heterocyclic group represented by $R^{31}$ or $R^{32}$ is a 5-or 6-membered ring residue which is constituted with carbon atoms and at least one hetero atom selected from the group consisting of a nitrogen atom, an oxygen atom and a sulfur atom, and may be condensed with a benzene ring, with specific examples including pyridyl, pyrrolyl, pyrazolyl, triazolyl, triazolidyl, imidazolyl, tetrazolyl, thiazolyl, oxazolyl, thiadiazolyl, oxadiazolyl, quinolinyl, benzothiazolyl, benzoxazolyl, benzimidazolyl and so on.

Suitable examples of a substituent which the group represented by $R^{31}$ or $R^{32}$ may have include aryl groups (e.g., phenyl, naphthyl, etc.), a nitro group, a hydroxyl group, a cyano group, a sulfo group, alkoxy groups (e.g., methoxy, ethoxy, methoxyethoxy, etc.), aryloxy groups (e.g., phenoxy, naphthyloxy, etc.), a carboxyl group, acyloxy groups (e.g., acetoxy, benzoxy, etc.), acylamino groups (e.g., acetylamino, benzoylamino, etc.), sulfonamido groups (e.g., methanesulfonamido, benzenesulfonamido, etc.), sulfamoyl groups (e.g., methylsulfamoyl, phenylsulfamoyl, etc.), halogen atoms (e.g., fluorine, chlorine, bromine, etc.), carbamoyl groups (e.g., N-methylcarbamoyl, N-2-methoxyethylcarba-2-moyl, N-phenylcarbamoyl, etc.), alkoxycarbonyl groups (e.g., methoxycarbonyl, ethoxycarbonyl, etc.), acyl groups (e.g., acetyl, benzoyl, etc.), sulfonyl groups (e.g., methylsulfonyl, phenylsulfonyl, etc.), sulfinyl groups (e.g., methylsulfinyl, phenylsulfinyl, etc.), heterocyclic groups (e.g., morpholino, pyrazolyl, triazolyl, tetrazolyl, imidazolyl, pyridyl, benzotriazolyl, benzimidazolyl, etc.), amino groups (e.g., non-substituted amino, methylamino, ethylamino, etc.), alkylthio groups (e.g., methylthio, ethylthio, carboxymethylthio, etc.) and arylthio groups (e.g., phenylthio, etc.). These substituents each may be further substituted with one of the above-described substituents.

Among the couplers represented by the general formula (VI), those which are represented by the following general formula (VII) are used to greater advantage.

$$(R^{33}—A^1)_mZ \qquad \text{(VII)}$$

wherein m represents 1 or 2, $A^1$ represents a cyan image forming coupler residue having a phenol nucleus or a cyan image forming coupler residue having an α-naphthol nucleus, and Z represents a group which is attached to the coupling site of the above-described coupler residue and that, released therefrom when the cyan dye is formed through the oxidative coupling reaction with an aromatic primary amine developer, that is, the group having the same meaning as described in the general formula (VI).

Suitable examples of $R^{33}$ in the general formula (VII) include a hydrogen atom; alkyl groups having 30 or less, preferably 1 to 20, carbon atoms, especially methyl, isopropyl, pentadecyl, eicosyl and so on; alkoxy groups having 30 or less, preferably 1 to 20, carbon atoms, especially methoxy, isopropoxy, pentadecyloxy and eicosyloxy; aryloxy groups such as phenoxy and p-tert-butylphenoxy; acylamino groups represented by the following general formulae (A) to (D), respectively; and carbamyl groups represented by the following general formulae (E) and (F), respectively.

$$—NH—CO—X \qquad \text{(A)}$$

$$—NH—SO_2—X \qquad \text{(B)}$$

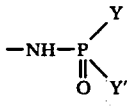

(C)

$$—NHCONH—X \qquad \text{(D)}$$

$$—CONHX \qquad \text{(E)}$$

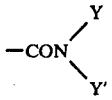

(F)

wherein X represents a straight or branched chain alkyl group having 1 to 32, preferably 1 to 20, carbon atoms, a cyclic alkyl group (e.g., cyclopropyl, cyclohexyl, norbornyl, etc.) or an aryl group (e.g., phenyl, naphthyl, etc.). The above-described alkyl group and aryl group each may be substituted with a halogen atom, a nitro group, a cyano group, a hydroxyl group, a carboxy group, an amino group (e.g., amino, alkylamino, dialkylamino, anilino, N-alkylanilino, etc.), an aryl group, an alkoxycarbonyl group, an acyloxycarbonyl group, an amino group (e.g., acetamido, methanesulfonamido, etc.), an imido group (e.g., succinimido, etc.), a carbamoyl group (e.g., N,N-dihexylcarbamoyl, etc.), a sulfamoyl group (e.g., N,N-diethylsulfamoyl, etc.), an alkoxy group (e.g., ethoxy, octadecyloxy, etc.), an aryloxy group (e.g., phenoxy, p-tert-butylphenoxy, 4-hydroxy-3-tert-butylphenoxy, etc.) and so on. Y and Y' each represents a group selected from the class consisting of the above-described X, —OX, —NH—X and $—NX_2$. $R^{33}$ may be substituted with a conventionally used substituent in addition to the above-described substituents.

Among the compounds represented by the above-described general formula (VII), particularly preferable ones are represented by the following general formula (VIII) or (IX):

(VIII)

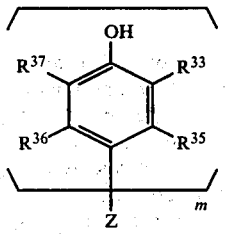

(IX)

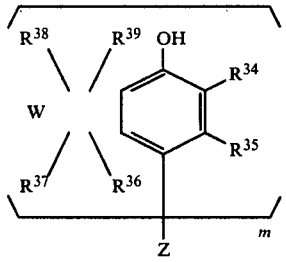

wherein m, Z and $R^{33}$ have the same meanings as those in the general formula (VII), respectively.

$R^{34}$ represents a hydrogen atom, an alkyl group containing 30 or less, preferably 1 to 20, of carbon atoms, or a carbamoyl group selected from those which are represented by the general formula (E) or (F), which are described as suitable examples of $R^{33}$ in the general formula (VII).

$R^{35}$, $R^{36}$, $R^{37}$, $R^{38}$ and $R^{39}$ each represents a hydrogen atom, a halogen atom, an alkyl group, an aryl group, an alkoxy group, an alkylthio group, a heterocyclic group, an amino group, a carbonamido group, a sulfonamido group, a sulfamyl group or a carbamyl group.

W represents non-metal atoms necessary to form a 5- or 6-membered ring by fusing with the benzene ring.

More specifically, suitable examples of $R^{35}$ include a hydrogen atom; primary, secondary and tertiary alkyl groups containing 1 to 22 carbon atoms, such as methyl, propyl, isopropyl, n-butyl, sec-butyl, tert-butyl, hexyl, dodecyl, 2-chlorobutyl, 2-hydroxyethyl, 2-phenylethyl, 2-(2,4,6-trichlorophenyl)ethyl, 2-aminoethyl, etc.; aryl groups, such as phenyl, 4-methylphenyl, 2,4,6-trichlorophenyl, 3,5-dibromophenyl, 4-trifluoromethylphenyl, 2-trifluoromethylphenyl, 3-trifluoromethylphenyl, naphthyl, 2-chloronaphthyl, 3-ethylnaphthyl, etc.; and heterocyclic groups, such as benzofuranyl, furanyl, thiazolyl, benzothiazolyl, naphthothiazolyl, oxazolyl, benzoxazolyl, naphthoxazolyl, pyridyl, quinolinyl, etc. Further, $R^{35}$ may also represent an amino group, such as amino, methylamino, diethylamino, dodecylamino, phenylamino, tolylamino, 4-(3-sulfobenzamido)anilino, 4-cyanophenylamino, 2-trifluoromethylphenylamino, benzothiazolamino, etc.; a carbonamido group, e.g., an alkylcarbonamido group such as ethylcarbonamido, decylcarbonamido, phenylethylcarbonamido, etc., an arylcarbonamido group such as phenylcarbonamido, 2,4,6-trichlorophenylcarbonamido, 4-methylphenylcarbonamido, 2-ethoxyphenylcarbonamido, 3-[α-(2,4-di-tert-amylphenoxy)acetamido]benzamido, naphthylcarbonamido, etc., and a heterocyclic carbonamido group such as thiazolylcarbonamido, benzothiazolylcarbonamido, naphthothiazolylcarbonamido, oxazolylcarbonamido, benzoxazolylcarbonamido, imidazolylcarbonamido, benzimidazolylcarbonamido, etc.; a sulfonamido group, e.g., an alkylsulfonamido group such as butylsulfonamido, dodecylsulfonamido, phenylethylsulfonamido, etc., an arylsulfonamido group such as phenylsulfonamido, 2,4,6-trichlorophenylsulfonamido, 2-methoxyphenylsulfonamido, 3-carboxyphenylsulfonamido, naphthylsulfonamido, etc., and a heterocyclic sulfonamido group such as thiazolylsulfonamido, benzothiazolylsulfonamido, imidazolylsulfonamido, benzimidazolylsulfonamido, pyridylsulfonamido, etc.; a sulfamyl group, e.g., an alkylsulfamyl group such as propylsulfamyl, octylsulfamyl, pentadecylsulfamyl, octadecylsulfamyl, etc., an arylsulfamyl group such as phenylsulfamyl, 2,4,6-trichlorophenylsulfamyl, 2-methoxyphenylsulfamyl, naphthylsulfamyl, etc., and a heterocyclic sulfamyl group such as thiazolylsulfamyl, benzothiazolylsulfamyl, oxazolylsulfamyl, benzimidazolylsulfamyl, pyridylsulfamyl, etc.; and a carbamyl group, e.g., an alkylcarbamyl group such as ethylcarbamyl, octylcarbamyl, pentadecylcarbamyl, octadecylcarbamyl, etc., an arylcarbamyl group such as phenylcarbamyl, 2,4,6-trichlorophenylcarbamyl, etc., and a heterocyclic carbamyl group such as thiazolylcarbamyl, benzothiazolylcarbamyl, oxazolylcarbamyl, imidazolylcarbamyl, benzimidazolylcarbamyl, etc. $R^{36}$, $R^{37}$, $R^{38}$ and $R^{39}$ each represents one of the groups defined as $R^{35}$, and W represents non-metal atoms necessary to form a 5- or 6-membered ring described below by fusing with the benzene ring. Suitable examples of the 5- or 6-membered ring include a benzene ring, a cyclohexene ring, a cyclopentene ring, a thiazole ring, an oxazole ring, an imidazole ring, a pyridine ring, a pyrrole ring, a tetrahydropyridine ring and so on.

Specific examples of the high speed reactive couplers represented by the general formulae (VI) to (IX) are illustrated below. However, those which can be employed in this invention should not be construed as being limited to the following examples.

VI-1

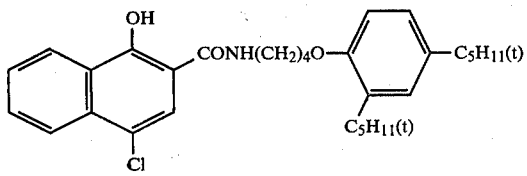

VI-2

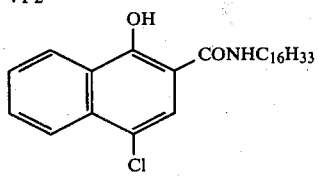

VI-3

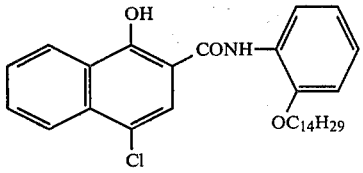

VI-4

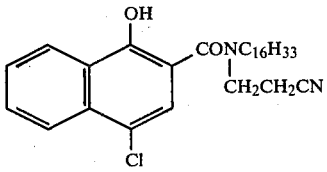

VI-5

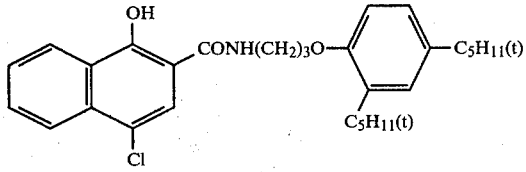

VI-6

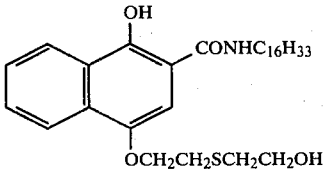

VI-7

VI-8

-continued
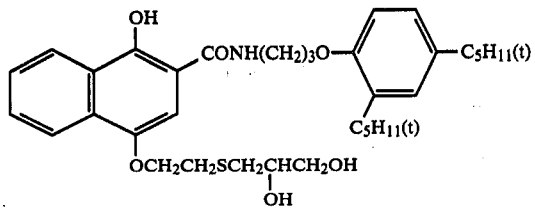
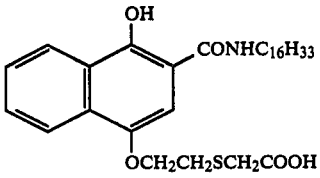
VI-9
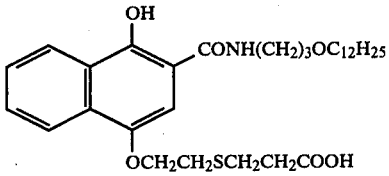
VI-10
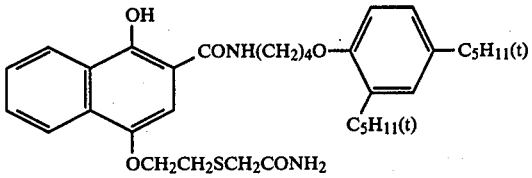
VI-11
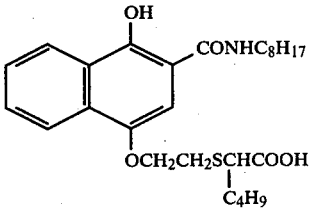
VI-12
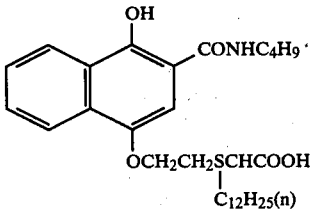
VI-13
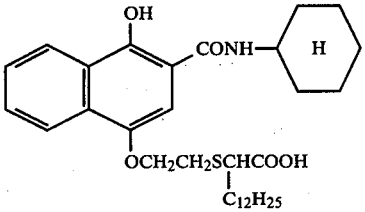
VI-14
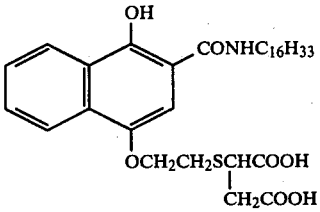
VI-15
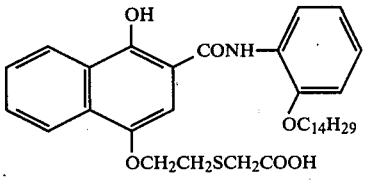
VI-16
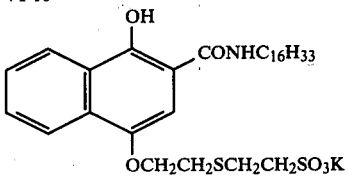
VI-17
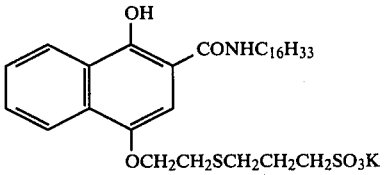
VI-18
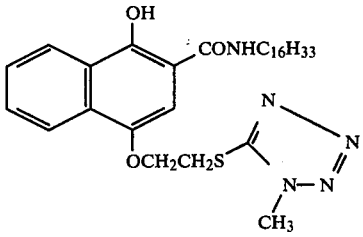
VI-19
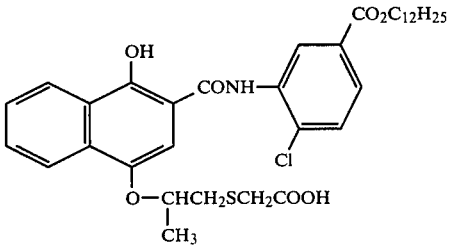
VI-20
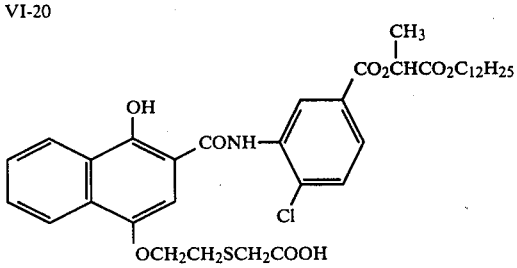

-continued
VI-21
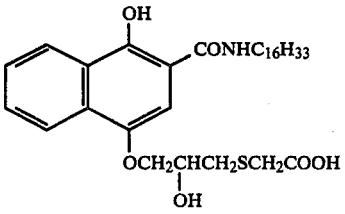
VI-22
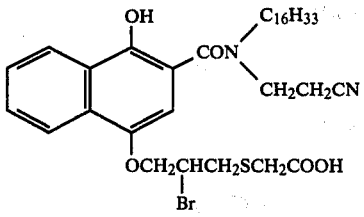
VI-23
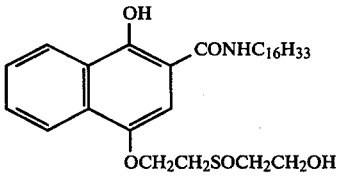
VI-24
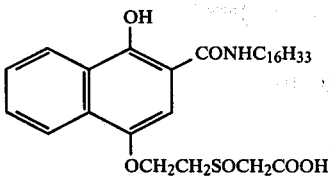
VI-25
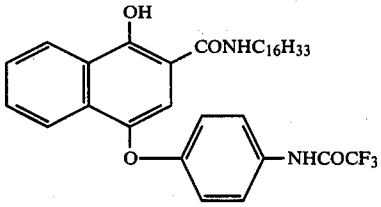
VI-26
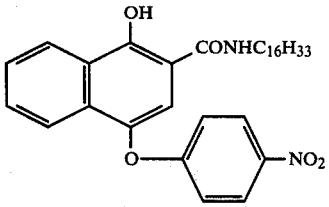
VI-27
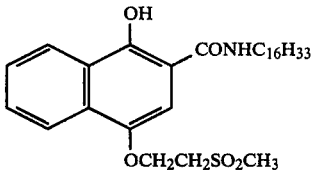
VI-28
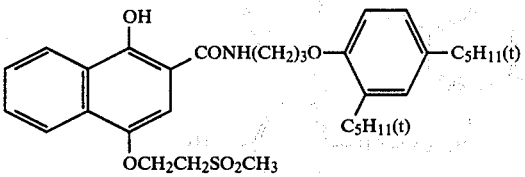
VI-29
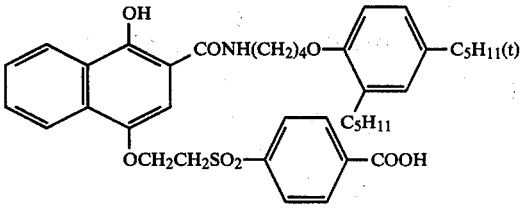
VI-30
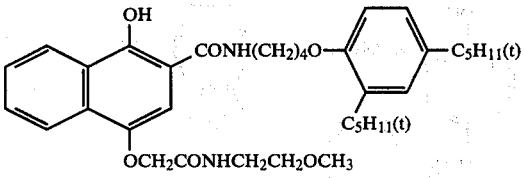
VI-31
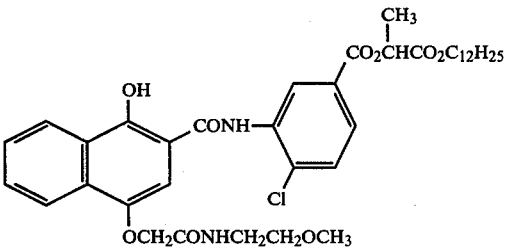
VI-32
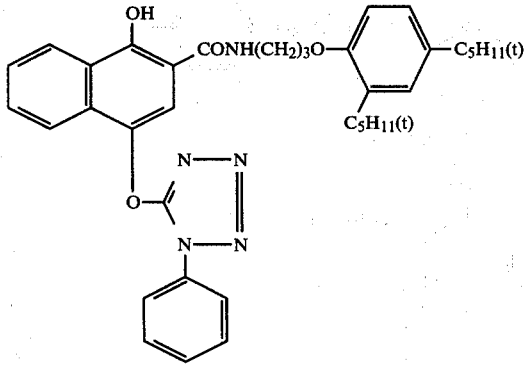
VI-33
VI-34

-continued
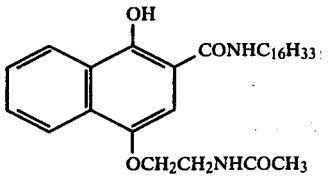
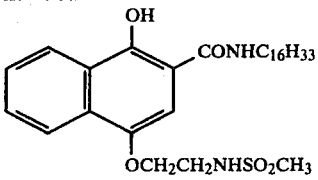
VI-35
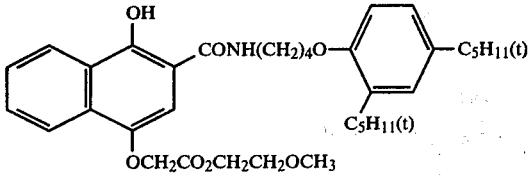
VI-36
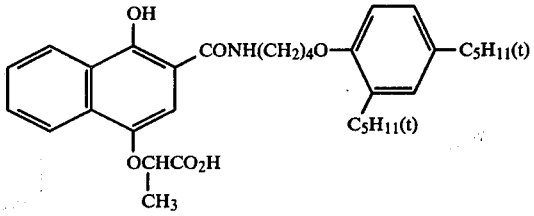
VI-37
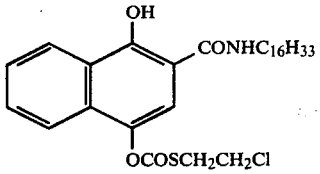
VI-38
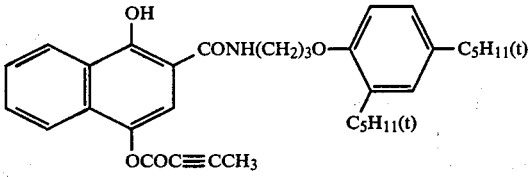
VI-39
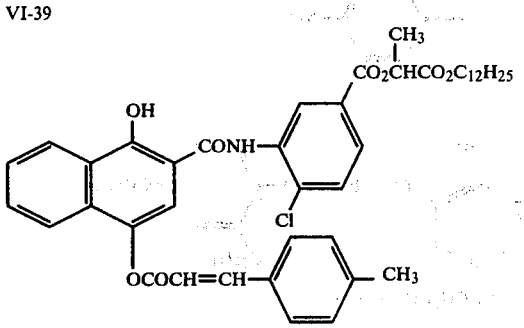
VI-40
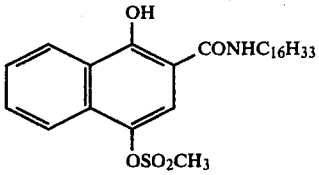
VI-41
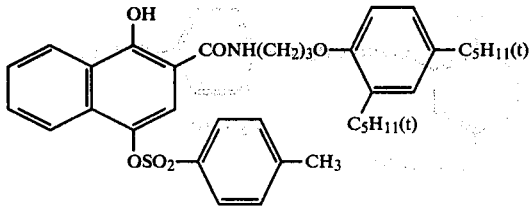
VI-42
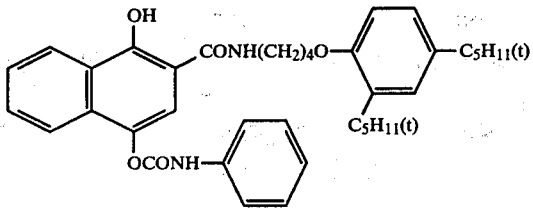
VI-43
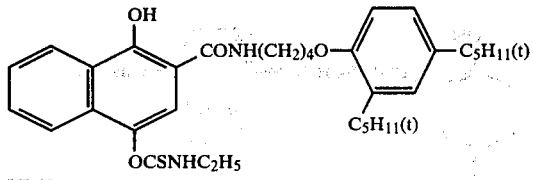
VI-44
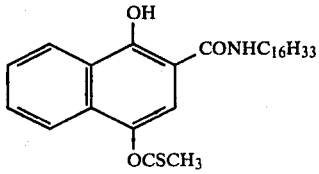
VI-45
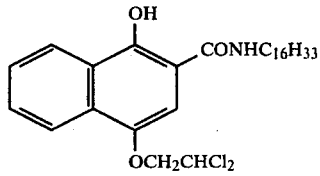
VI-46
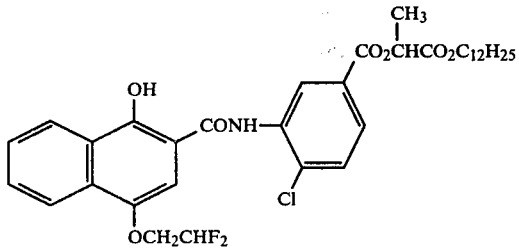

-continued
VI-47
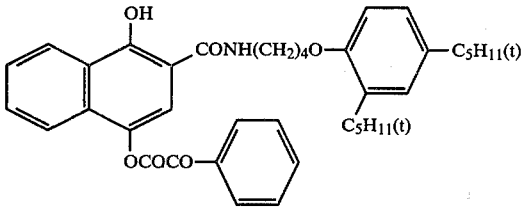
VI-48
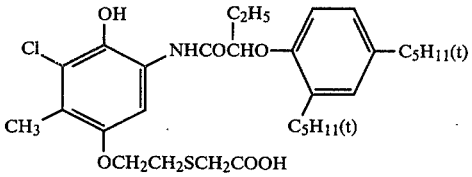
VI-49
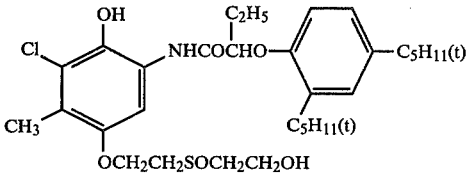
VI-50
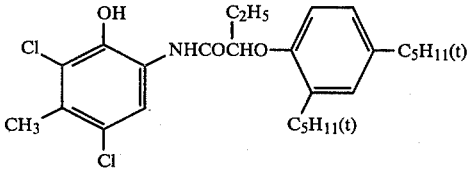
VI-51
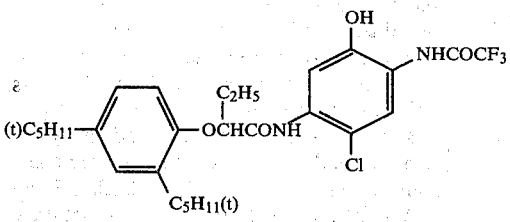
VI-52
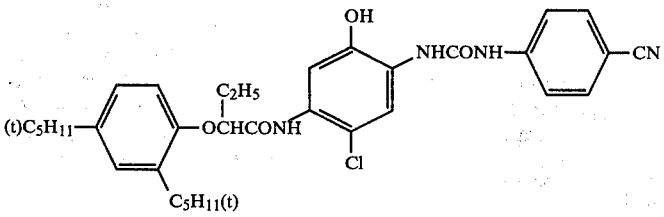
VI-53
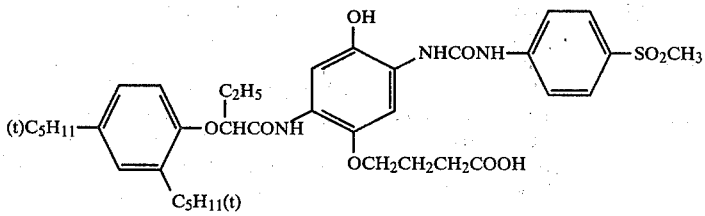
VI-54
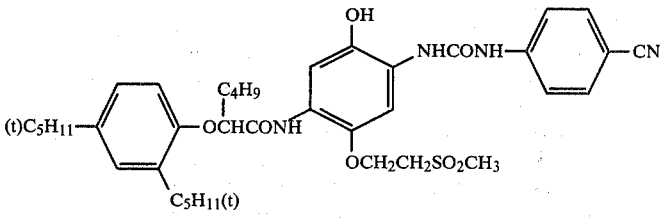
VI-55

-continued

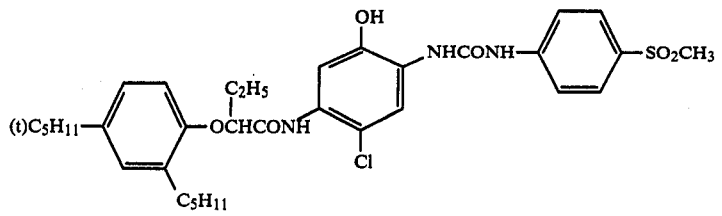

VI-56

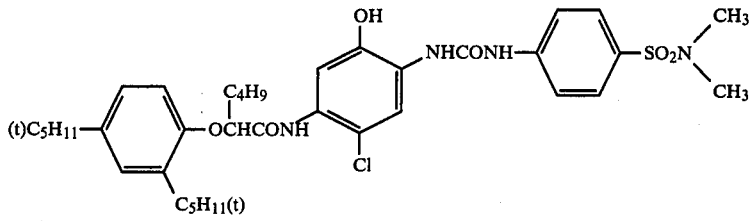

In general, the compound represented by the general formula (I) is synthesized as follows.

Namely, gallic acid is converted into 3,4,5-triacetoxybenzoic acid by reacting with acetic anhydride or acetic acid chloride in the presence of a base such as NaOH (*J. Chem. Soc.*, 2495 (1931)), $Na_2CO_3$, pyridine or so on and, further, converted into the corresponding acid chloride by reacting with thionyl chloride or phosphorus trichloride. The thus-obtained 3,4,5-triacetoxybenzoic acid chloride was made to react with an appropriate amine in the presence of a base such as pyridine, triethylamine or the like. Thereafter, the reaction product is treated with sodium acetate, sodium hydroxide or hydrochloric acid in methanol or ethanol to produce an intended gallic acid amide.

Specific examples of syntheses of the compounds of this invention are described in detail below.

SYNTHESIS EXAMPLE 1

Synthesis of 3,4,5-Triacetoxybenzoic Acid

To 37.6 g (0.2M) of gallic acid dissolved in 50 ml of acetonitrile was added 81.6 g (0.8M) of acetic anhydride in the presence of 63.3 g (0.8M) of pyridine as the reaction system was cooled with water. Then, the reaction system was heated to 60° C. for 2 hours to complete the reaction. Thereto, 150 ml of water was added and, further, 80 ml of hydrochloric acid was added as the reaction system was cooled in an ice bath. Thereupon, white crystals separated out. These were filtered off under reduced pressure, washed with water and air-dried. Thus, 57.5 g of the intended compound was obtained. Yield 97%, Melting Point 163°-166° C.

SYNTHESIS EXAMPLE 2

Synthesis of 3,4,5-Triacetoxybenzoic Acid Chloride

In 100 ml of 1,2-dichloroethane, 57 g (0.19M) of 3,4,5-triacetoxybenzoic acid and 34 g (0.29M) of thionyl chloride were made to react with each other at 60° C. for 2 hours. Excess thionyl chloride and 1,2-dichloroethane were distilled away under reduced pressure. Thus, 61 g of the intended compound was obtained.

SYNTHESIS EXAMPLE 3

Synthesis of Compound I-2

To 31 g (0.1M) of 3,4,5-triacetoxybenzoic acid chloride dissolved in 100 ml of acetonitrile was added a solution of 20.6 g (0.1M) of cetylamine and 10 g (0.1M) of triethylamine dissolved in 50 ml of acetonitrile as the reaction system was cooled with water. Further, the reaction was run at room temperature for 2 hours. Thereafter, 100 ml of water was added thereto to precipitate crystals. These were filtered off, and recrystallized from 800 ml of methanol. Thus, the intended triacetate was obtained. Yield 28 g (54%), Melting Point 93°-96° C. A 26 g (0.05M) portion of the thus-obtained triacetate was dissolved in 150 ml of methanol and thereto, 20 ml of hydrochloric acid was added. The reaction was run at 60° C. for 2 hours. Thereafter, the reaction mixture was adjusted to pH=4 using 22 g of sodium acetate. Crystals were precipitated by the addition of 150 ml of water, filtered off, and recrystallized from 250 ml of ethanol. Thus, the intended compound was obtained. Yield 18 g (91%), Melting Point 104°-108° C.

SYNTHESIS EXAMPLE 4

Synthesis of Compound I-8

To 31 g (0.1M) of 3,4,5-triacetoxybenzoic acid chloride dissolved in 100 ml of tetrahydrofuran was added a solution of 33 g (0.1M) of octadecyloxypropylamine and 10 g (0.1M) of triethylamine dissolved in 50 ml of tetrahydrofuran as the reaction system was cooled with water. Further, the reaction proceeded at room temperature for 4 hours. Thereafter, 200 ml of water was added thereto, and the reaction product was extracted with ethyl acetate. The extract was washed with water and concentrated. Then, it was recrystallized from an ethanol-methanol (250 ml/50 ml) mixture. Thus, the intended triacetate was obtained. Yield 43.5 g (72%). This triacetate was dissolved in a mixed solution consisting of 100 ml of methanol and 50 ml of THF and thereto 2 g of sodium acetate was added. The reaction proceeded at 50° C. for 2 hours. Thereafter, the reaction mixture was neutralized with 24 ml of 1N hydrochloric acid and thereto 300 ml of water was added. Thereupon, crystals separated out. These were filtered off, and recrystallized from 140 ml of chloroform. Thus, 26 g (76%) of the intended compound was obtained. Melting Point 106°-107.5° C.

SYNTHESIS EXAMPLE 5

Synthesis of Compound I-13

After 31 g (0.1M) of 3,4,5-triacetoxybenzoic acid chloride was made to react with 30.5 g (0.1M) of 2-tetradecyloxyaniline in the same manner as described in the Synthesis Example 3, the reaction product was recrystallized from methanol. Yield 26 g (58%), Melting Point 133°-136° C.

SYNTHESIS EXAMPLE 6

Synthesis of Compound I-11

In 700 ml of toluene, 296 g (1.0M) of 3,4,5-triacetoxybenzoic acid was made to react with 143 g (1.2M) of thionyl chloride in the presence of 5 ml of dimethylformamide at 60° C. for 3 hours. After toluene was distilled away under reduced pressure, 700 ml of acetonitrile was added and, further, an acetonitrile (200 ml) solution in which 277 g (0.95M) of 3-(2,4-di-tert-amylphenoxy)propylamine and 102 g (1.0M) of triethylamine were dissolved was dropwise added as the reaction system was cooled in an ice bath. Further, the reaction was run at 15° C. for 2 hours. Thereafter, 750 ml of water was added to the reaction mixture and the product was extracted with ethyl acetate, washed with water twice, and condensed.

In 1 liter of methanol, the thus-obtained triacetate was made to react with 17 g of sodium acetate at 50° C. for 2 hours, and thereto was added 204 ml of 1N hydrochloric acid. A waxy matter was separated out by the addition of 1 liter of water. It was taken out by decantation, and recrystallized from 1.3 liter of acetonitrile to obtain 262 g of the intended compound. Yield 63%, Melting Point 170°-171° C.

SYNTHESIS EXAMPLE 7

Synthesis of Compound I-29

After 233 g (0.75M) of 3,4,5-triacetoxybenzoic acid chloride was made to react with 278 g (0.68M) of 2-chloro-5-(1-dodecyloxycarbonylethoxycarbonyl)aniline in 800 ml of acetonitrile in the presence of 61 ml (0.75M) of pyridine, the intended compound was produced in the same manner as described in Synthesis Example 6. Yield 114 g, Melting Point 118°-120° C. (acetonitrile).

Other compounds can be synthesized in the same manner as described above.

All of couplers represented by the general formulae (II) to (VI) are known compounds. For instance, those which are represented by the general formulae (II) to (IV) are described in Japanese Patent Publication No. 10783/76, Japanese Patent Application (OPI) Nos. 66834/73, 66835/73, 102636/76, 122335/74, 34232/75, 9529/78, 39126/78, 47827/78 and 105226/78, Japanese Patent Publication No. 13576/74, Japanese Patent Application (OPI) Nos. 89729/76 and 75521/76, U.S. Pat. Nos. 4,059,447 and 3,894,875, and so on. Couplers represented by the general formula (V) are described in Japanese Patent Application (OPI) Nos. 122935/75, 126833/81, 38043/81, 46223/81, 58922/77, 20826/76, 122335/74 and 159336/75, Japanese Patent Publication Nos. 10100/76 and 37540/75, Japanese Patent Application (OPI) Nos. 112343/76, 47827/78 and 39126/78, Japanese Patent Publication No. 15471/70, U.S. Pat. No. 3,227,554, and RD 16,140. Couplers represented by the general formula (VI) are described in Japanese Patent Application (OPI) Nos. 27147/81, 1938/81, 117422/75, 37425/72, 48237/79, 52423/78, 105226/78, 45524/78, 47827/78, 29745/78, 10135/75 and 120334/75, U.S. Pat. No. 3,476,563, and so on.

It is most advantageous to add the compound represented by the general formula (I) directly to a silver halide emulsion layer. However, it may be added to a light-insensitive layer, such as an interlayer, a protective layer, a yellow filter layer, an antihalation layer or so on. The compound of this invention is firstly dissolved in a high boiling point solvent and, subsequently, dispersed into an aqueous solution of a hydrophilic colloid and then added to a composition for forming one of the above-described layers. Also, it may be dissolved in a low boiling point solvent and added to a composition for forming one of the above-described layers.

On the other hand, the compound (I) of this invention can be used in the form of mixture with a conventionally employed dihydroxybenzene derivative.

Good results are obtained when the compound (I) is added in the range of 1 to 100 mole%, particularly 5 to 50 mole%, per mole of coupler.

Photographic emulsions to be employed in this invention can be prepared using various methods as described in, for example, P. Glafkides, *Chimie et Physique Photographique,* Paul Montel, Paris (1967), G. F. Duffin, *Photographic Emulsion Chemistry,* The Focal Press, London (1966), and V. L. Zelikman et al., *Making and Coating Photographic Emulsion,* The Focal Press, London (1964). Namely, the acid process, the neutral process, the ammonia process and so on may be employed. Suitable methods for reacting a water-soluble silver salt with a water-soluble halide include, e.g., a single jet method, a double jet method and a combination thereof.

Also, a method in which silver halide grains are produced in the presence of excess silver ion (the so-called reverse jet method) can be employed in this invention. Further, the so-called controlled double jet method, in which the pAg of the liquid phase in which silver halide grains are to be precipitated is maintained constant, may be employed herein. According to this method, emulsions containing silver halide grains which have regular crystal forms and almost uniform grain sizes can be produced.

Two or more of silver halide emulsions prepared separately may be employed in a form of mixture thereof.

In a process of producing silver halide grains or allowing the produced silver halide grains to ripen physically, cadmium salts, zinc salts, lead salts, thallium salts, iridium salts or complexes, rhodium salts or complexes, iron salts or complexes and/or the like may be present.

In general, after the production of silver halide emulsions or after the physical ripening thereof, soluble salts are removed from the silver halide emulsions. The removal can be effected using the noodle washing method which comprises gelling the gelatin, or using a sedimentation process (thereby causing flocculation in the emulsion) which takes advantage of a sedimenting agent such as inorganic salts, anionic surface active agents, anionic polymers (e.g., polystyrenesulfonic acid), or gelatin derivatives (e.g., acylated gelatins, carbamoylated gelatins, etc.).

The silver halide emulsions of this invention are generally subjected to chemical sensitization. The chemical sensitization can be carried out using processes as described in H. Frieser, *Die Grundlagen der Photographisc-*

*hen Prozesse mit Silberhalogeniden,* pages 675 to 734, Akademische Verlagsgesellschaft (1968), and so on.

As for a binder or a protective colloid to be employed in photographic emulsions, gelatin is used to greater advantage. However, hydrophilic colloids other than gelatin can also be employed.

Specific examples of such hydrophilic colloids include proteins such as gelatin derivatives, gelatin grafted high polymers, albumin, casein, etc.; sugar derivatives such as cellulose derivatives, e.g., hydroxyethyl cellulose, carboxymethyl cellulose, cellulose sulfate, etc., sodium alginate, starch derivatives and the like; and various kinds of synthetic hydrophilic homo- or copolymers such as polyvinyl alcohol, polyvinyl alcohol partial acetal, poly-N-vinylpyrrolidone, polyacrylic acid, polymethacrylic acid, polyacrylamide, polyvinyl imidazole, polyvinyl pyrazole and so on.

Gelatin which may be employed in this invention includes not only lime-processed gelatin but also acid-processed gelatin, and enzyme-processed gelatin as described in *Bull. Soc. Sci. Phot. Japan,* No. 16, p. 30 (1966). In addition, hydrolysis products of gelatin and enzymatic degradation products of gelatin can also be employed. Gelatin derivatives which can be employed in this invention include those which are obtained by reacting gelatin with various kinds of compounds, for example, acid halides, acid anhydrides, isocyanates, bromoacetic acid, alkane sultones, vinyl sulfonamides, maleinimide compounds, polyalkylene oxides, epoxy compounds and so on. Specific examples thereof are described in U.S. Pat. Nos. 2,614,928, 3,132,945, 3,186,846 and 3,312,553, British Pat. Nos. 861,414, 1,033,189 and 1,005,784, Japanese Patent Publication No. 26845/67, and so on.

The above-described gelatin grafted high polymers which can be employed include those which are obtained by grafting on gelatin homo- or copolymers of vinyl monomers such as acrylic acid, methacrylic acid, esters thereof, amido thereof, other derivatives thereof, acrylonitrile, styrene and so on. Among these polymers, those which are obtained by grafting, on gelatin, polymers being compatible with gelatin to some extents, e.g., polymers of acrylic acid, methacrylic acid, acrylamide, methacrylamide, hydroxyalkylmethacrylates and the like are more advantageously employed. Specific examples of such grafted polymers are described in U.S. Pat. Nos. 2,763,625, 2,831,767 and 2,956,884, and so on.

Representatives of synthetic hydrophilic macromolecular compounds which can be employed are described in German Patent Application (OLS) No. 2,312,708, U.S. Pat. Nos. 3,620,758 and 3,879,205, and Japanese Patent Publication No. 7561/68.

In the photographic emulsions of this invention, various kinds of compounds can be incorporated for the purposes of preventing fog from generating during preparation of the sensitive materials, upon storage of the sensitive materials or in the course of photographic processings, or stabilizing photographic properties of the sensitive materials. Suitable examples of compounds employed for such purposes include azoles such as benzothiazolium salts, nitroindazoles, triazoles, benzotriazoles, benzimidazoles (especially nitro or halogen substituted ones), etc.; heterocyclic mercapto compounds such as mercaptothiazoles, mercaptobenzothiazoles, mercaptobenzimidazoles, mercaptothiadiazoles, mercaptotetrazoles (especially 1-phenyl-5-mercaptotetrazole), mercaptopyrimidines, etc.; the above-described heterocyclic mercapto compounds which have additionally water-soluble groups such as carboxyl group, sulfone group and the like; thioketone compounds such as oxazolinethione, etc.; azaindenes such as tetraazaindenes (especially 4-hydroxy-1,3,3a,7-tetraazaindenes), etc.; benzenethiosulfonic acids; benzenesulfonic acid; and other various compounds which have been known as antifogging agents or stabilizing agents.

Details of specific examples and usages of these antifogging agents and stabilizing agents are described in U.S. Pat. Nos. 3,954,474, 3,982,947 and 4,021,248, and Japanese Patent Publication No. 28660/77.

The photographic emulsions of this invention may be spectrally sensitized using methine dyes or other dyes. Suitable spectral sensitizing dyes which can be employed include those which are described in German Pat. No. 929,080, U.S. Pat. Nos. 2,493,748, 2,503,776, 2,519,001, 2,912,329, 3,656,959, 3,672,897 and 4,025,349, British Pat. No. 1,242,588, and Japanese Patent Publication No. 14030/69.

These sensitizing dyes may be employed individually or in combination. Combinations of sensitizing dyes are often employed for the purpose of supersensitization. Typical examples of supersensitizing combinations are described in U.S. Pat. Nos. 2,688,545, 2,977,229, 3,397,060, 3,522,052, 3,527,641, 3,617,293, 3,628,964, 3,666,480, 3,672,898, 3,679,428, 3,814,609 and 4,026,707, British Pat. No. 1,344,281, Japanese Patent Publication Nos. 4936/68 and 12375/78, and Japanese Patent Application (OPI) Nos. 110618/77 and 109925/77.

The photographic emulsion layers and other hydrophilic colloid layers of the photographic materials prepared in accordance with embodiments of this invention may contain inorganic or organic hardeners. For example, chromium salts (such as chrome alum, chromium acetate, etc.), aldehydes (such as formaldehyde, glyoxal, glutaraldehyde, etc.), N-methylol compounds (such as dimethylolurea, methylol dimethylhydantoin, etc.), dioxane derivatives (such as 2,3-dihydroxydioxane, etc.), active vinyl compounds (such as 1,3,5-triacryloylhexahydro-s-triazine, 1,3-vinylsulfonyl-2-propanol, etc.), active halogen-containing compounds (such as 2,4-dichloro-6-hydroxy-s-triazine, etc.), mucohalogenic acids (such as mucochloric acid, mucophenoxychloric acid, etc.) and so on can be employed individually or in a combination of two or more thereof.

In the photographic emulsions of this invention, color forming couplers, other than those having the general formulae (II) to (VI), that is to say, compounds capable of forming colors by the oxidative coupling with aromatic primary amine developing agents (e.g., phenylenediamine derivatives, aminophenol derivatives, etc.) in the color development processing, can be incorporated. Specific examples of magenta couplers include 5-pyrazolone couplers, pyrazolobenzimidazole couplers, cyanoacetylcumaron couplers, open-chain acylacetonitrile couplers and so on. Specific examples of yellow couplers include acylacetamide couplers (e.g., benzoylacetanilides, pivaloyl acetanilides, etc.), and so on. Specific examples of cyan couplers include naphthol couplers, phenol couplers and so on. In addition, polymer couplers described in U.S. Pat. Nos. 4,080,211, 3,451,820 and 3,370,952, and so on can be employed. The above-described couplers may be employed individually or in combination. Of these couplers, nondiffusion type couplers which have hydrophobic groups called ballast groups in their individual molecules are employed to greater advantage. These couplers may be either 4-equivalent or 2-equivalent with respect to silver ions. Further, colored couplers having color correction effects, or couplers capable of releasing development inhibitors with the progress of development (the so-called DIR couplers) may be contained.

Besides DIR couplers, colorless DIR coupling compounds which yield colorless products upon the coupling reaction and that can release development inhibitors may be incorporated in the photographic emulsions of this invention.

These couplers are introduced into silver halide emulsion layers using known methods as described in, for example, U.S. Pat. No. 2,322,027. For instance, these couplers are dissolved in high boiling point solvents, with specific examples including alkyl phthalates (such as dibutyl phthalate, dioctyl phthalate, etc.), phosphates (such as diphenyl phosphate, triphenyl phosphate, tricresyl phosphate, dioctylbutyl phosphate, etc.), citrates (such as tributyl acetylcitrate, etc.), benzoates (such as octylbenzoate, etc.), alkylamides (such as diethyl lauryl amide, etc.), fatty acid esters (such as dibutoxyethyl succinate, dioctyl azeate, etc.), trimesic acid esters (such as tributyl trimesate, etc.) and so on; or in organic solvents having boiling points of about 30° C. to about 150° C., with specific examples including lower alkyl acetates such as ethyl acetate, butyl acetate, etc., ethyl propionate, sec-butyl alcohol, methyl isobutyl ketone, β-ethoxyethyl acetate, methyl cellosolve acetate and so on; and then dispersed into hydrophilic colloids. Mixtures of the above-described high boiling point organic solvents and the above-described low boiling point organic solvents may be employed for dissolving such couplers.

In addition, such couplers may be dispersed using the dispersing method which comprises utilizing polymers, as described in Japanese Patent Publication No. 39853/76 and Japanese Patent Application (OPI) No. 59943/76.

On the occasion that couplers contain acid groups such as carboxylic acid, sulfonic acid and the like, these are introduced into hydrophilic colloids in the form of an alkaline aqueous solution.

Photographic processings of the sensitive materials prepared in accordance with embodiments of this invention can be carried out using known methods. Processing solutions which can be employed include those which have so far been known. Processing temperatures are generally selected from the range of 18° C. to 50° C. However, temperatures lower than 18° C. or temperatures higher than 50° C. may be employed. Either the development processing for forming silver image (black-and-white photographic processing) or the color photographic processing which comprises a development processing for forming dye image can be applied to the sensitive materials of this invention according to their end-use purposes.

Developing solutions to be employed in the case of black-and-white photographic processing can contain known developing agents. Specific examples of developing agents which can be employed include dihydroxybenzenes (such as hydroquinone), 3-pyrazolidones (such as 1-phenyl-3-pyrazolidone), aminophenols (such as N-methyl-p-aminophenol), 1-phenyl-3-pyrazolines, ascorbic acid, and heterocyclic compounds such as that which is produced by condensation of 1,2,3,4-tetrahydroquinoline ring and indolene ring as described in U.S. Pat. No. 4,067,872. These developing agents may be employed individually or in combination. In addition to such a developing agent, the developing solution may generally contain a known preservative, alkali agent, pH buffer and antifoggant and, further, it may optionally contain a dissolving aid, a color toning agent, a development accelerator, a surface active agent, a defoaming agent, a water softener, a hardener, a viscosity imparting agent and so on.

The development processing may be carried out in such a special manner that a developing agent is incorporated in a sensitive material, for example, in its emulsion layer and the sensitive material is processed in an alkaline aqueous solution. Hydrophobic ones in the above-described developing agents can be incorporated in emulsion layers in a form of latex dispersion, as disclosed in *Research Disclosure,* No. 169, RD-16928. Such development processing as described above may be carried out in combination with the silver salt stabilizing processing using a thiocyanate.

Fixing solutions which can be employed include those which have conventional compositions.

Suitable examples of fixing agents which can be employed include thiosulfates, thiocyanates and organic sulfur compounds which have so far been known to have fixing effects.

The fixing solution may contain a water-soluble aluminum salt as a hardener.

Dye images can be formed in conventional manners. For instance, the nega-posi process (described in, for example, *Journal of the Society of Motion Picture and Television Engineers,* Vol. 61, pp. 667–701 (1953)); the color reversal process which comprises forming negative silver image through development using a developing solution containing a black-and-white developing agent, carrying out at least one uniform exposure or another appropriate fogging treatment, and carrying out color development to produce a positive dye image; silver dye bleach process which comprises forming silver image by developing an exposed dye-containing photographic emulsion layers, and bleaching dyes utilizing the silver image as catalyst; and so on can be employed.

A color developing solution generally comprises an alkaline aqueous solution containing a color developing agent. Suitable examples of the color developing agent which can be employed include known aromatic primary amine developers, such as phenylenediamines (e.g., 4-amino-N,N-diethylaniline, 3-methyl-4-amino-N,N-diethylaniline, 4-amino-N-ethyl-N-β-hydroxyethylaniline, 3-methyl-4-amino-N-ethyl-N-β-hydroxyethylaniline, 3-methyl-4-amino-N-ethyl-N-β-methanesulfonamidoethylaniline, 4-amino-3-methyl-N-ethyl-N-β-methoxyethylaniline, etc.).

In addition to the above-described color developing agents, those which are described in L. F. A. Mason, *Photographic Processing Chemistry,* pp. 226–229, Focal Press, London (1966), U.S. Pat. Nos. 2,193,015 and 2,592,364, Japanese Patent Application (OPI) No. 64933/73, and so on may be employed.

The color developing solution can additionally contain pH buffers such as sulfites, carbonates, borates and phosphates of alkali metals; development restrainers or antifoggants such as bromides, iodides and organic antifoggants; and so on. Further, it may optionally contain water softeners; preservatives such as hydroxyamine; organic solvents such as benzyl alcohol, diethylene glycol and the like; development accelerators such as polyethylene glycol, quaternary ammonium salts, amines and the like; dye forming couplers; competing couplers; fogging agents such as sodium borohydride; assistant developers such as 1-phenyl-3-pyrazolidone; viscosity imparting agents; polycarboxylic acid series chelating agents described in U.S. Pat. No. 4,083,723; oxidation inhibitors described in German Patent Application (OLS) No. 2,622,950; and so on.

After the color development, photographic emulsion layers are generally subjected to a bleach processing. The bleach processing may be carried out simultaneously with a fixation processing or subsequently thereto. Bleaching agents which can be employed include compounds of polyvalent metals such as Fe (III), Co (III), Cr (VI), Cu (II) and the like; peroxy acids; quinones; nitroso compounds; and so on. Specific examples thereof include ferricyanides; dichromates; organic complex salts of Fe (III) or Co (III), for example, the complex salts of organic acids such as aminopolycarboxylic acids (e.g., ethylenediaminetetraacetic acid, nitrilotriacetic acid, 1,3-diamino-2-propanoltetraacetic acid, etc.), citric acid, tartaric acid, malic acid and so on; persulfates and permanganates; nitrosophenol; and so on. Among these bleaching agents, potassium ferricyanide, sodium ethylenediaminetetraacetatoferrate (III) and ammonium ethylenediaminetetraacetatoferrate (III) are especially useful. In particular, ethylenediaminetetraacetatoiron (III) complexes are used to advantage in both independent bleaching solutions and combined bleaching and fixing solutions.

To a bleaching solution or a bleaching-and-fixing solution can be added bleach accelerators described in, e.g., U.S. Pat. Nos. 3,042,520 and 3,241,966, Japanese Patent Publication Nos. 8506/70 and 8836/70, and so on; thiol compounds described in Japanese Patent Application (OPI) No. 65732/78; and other various kinds of additives.

The sensitive materials prepared in accordance with embodiments of this invention may be development-processed using developing solutions which are supplemented or controlled so as to maintain their developabilities constant using the methods described in Japanese Patent Application (OPI) Nos. 84636/76, 119934/77, 46732/78, 9626/79, 19741/79, 37731/79, 1048/81, 1049/81 and 27142/81.

The sensitive materials prepared in accordance with embodiments of this invention may be processed with bleaching-and-fixing solutions which have received recovering treatments according to the methods described in Japanese Patent Application (OPI) Nos. 781/71, 49437/73, 18191/73, 14523/75, 18541/76, 19535/76 and 144620/76, and Japanese Patent Publication No. 23178/76.

The present invention is explained in greater detail with reference to the examples below, but the present invention should not be construed as being limited thereto.

EXAMPLE 1

On a cellulose triacetate film support were coated the layers having compositions described below in this order to prepare a multilayer multicolor light-sensitive material.

(1) Antihalation layer (AHL) which was a gelatin layer containing black colloidal silver.

(2) Interlayer (ML) which was a gelatin layer containing an emulsified dispersion of 2,5-di-t-octylhydroquinone.

(3) First red-sensitive emulsion layer ($RL_1$) which was made up of a silver iodobromide emulsion containing 5 mol% of silver iodide, 1.79 g/m$^2$ of silver, $6\times10^{-5}$ mol/mol Ag of the sensitizing dye I, $1.5\times10^{-5}$ mol/mol Ag of the sensitizing dye II, 0.04 mol/mol Ag of the coupler A, 0.003 mol/mol Ag of the coupler C and 0.0006 mol/mol Ag of the coupler D.

(4) Second red-sensitive emulsion layer ($RL_2$) which was made up of a silver iodobromide emulsion (iodide content: 4 mol%) containing 1.4 g/m$^2$ of silver, $3\times10^{-5}$ mol/mol Ag of the sensitizing dye I, $1.2\times10^{-5}$ mol/mol Ag of the sensitizing dye II, 0.02 mol/mol Ag of Coupler VI-8, 0.005 mol/mol Ag of Compound (I-11), and 0.0016 mol/mol Ag of the coupler C. Therein, Compound (I-11) and the coupler were added to the emulsion in a form of emulsified dispersion.

(5) Interlayer (ML) which was the same one as the second layer.

(6) First green-sensitive emulsion layer ($GL_1$) which was made up of a silver iodobromide (iodide content: 4 mol%) containing 1.5 g/m$^2$ of silver, $3\times10^{-5}$ mol/mol Ag of the sensitizing dye III, $1\times10^{-5}$ mol/mol Ag of the sensitizing dye IV, 0.05 mol/mol Ag of the coupler B, 0.008 mol/mol Ag of the coupler M and 0.0015 mol/mol Ag of the coupler D.

(7) Second green-sensitive emulsion layer ($GL_2$) which was made up of a silver iodobromide (iodide content: 5 mol%) containing 1.6 g/m$^2$ of silver, $2.5\times10^{-5}$ mol/mol Ag of the sensitizing dye III, $0.8\times10^{-5}$ mol/mol Ag of the sensitizing dye IV, 0.02 mol/mol Ag of the coupler B, 0.003 mol/mol Ag of the coupler M and 0.0003 mol/mol Ag of the coupler D.

(8) Yellow filter layer (YFL) which was a gelatin layer containing yellow colloidal silver and an emulsified dispersion of 2,5-di-t-octylhydroquinone in an aqueous solution of gelatin.

(9) First blue-sensitive emulsion layer ($BL_1$) which was made up of a silver iodobromide emulsion (iodide content: 6 mol%) containing 1.5 g/m$^2$ of silver and 0.25 mol/mol Ag of the coupler II-24.

(10) Second blue-sensitive emulsion layer ($BL_2$) which was made up of a silver iodobromide emulsion (iodide content: 6 mol%) containing 1.1 g/m$^2$ of silver and 0.06 mol/mol Ag of the coupler II-24.

(11) Protective layer (PL) which was a gelatin layer containing polymethyl methacrylate particles (having a diameter of about 1.5 microns).

To each of the above-described layers, a gelatin hardener and a surface active agent were added in addition to the above-described composition.

The thus-prepared sample was named Sample 101.

Compounds employed for preparing the sample were as follows.

Sensitizing Dye I: Anhydro-5,5'-dichloro-3,3'-di(γ-sulfopropyl)-9-ethyl-thiacarbocyaninehydroxide.-pyridinium salt Sensitizing Dye II: Anhydro-9-ethyl-3,3'-di(γ-sulfopropyl)-4,5,4',5'-dibenzothiacarbocyaninehydroxide.triethylamine salt Sensitizing Dye III: Anhydro-9-ethyl-5,5'-dichloro-3,3'-di(γ-sulfopropyl)oxacarbocyanine.sodium salt Sensitizing Dye IV: Anhydro-5,6,5',6'-tetrachloro-1,1'-diethyl-3,3'-di{β-[β-(γ-sulfopropoxy)ethoxy]ethyl}imidazolocarbocyaninehydroxide.sodium salt Coupler A

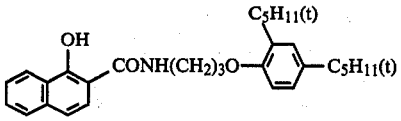

Coupler B

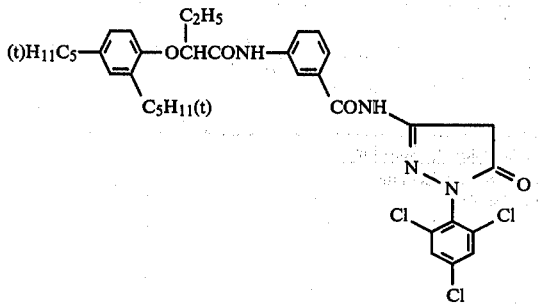

Coupler C

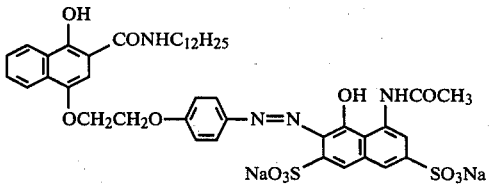

Coupler D

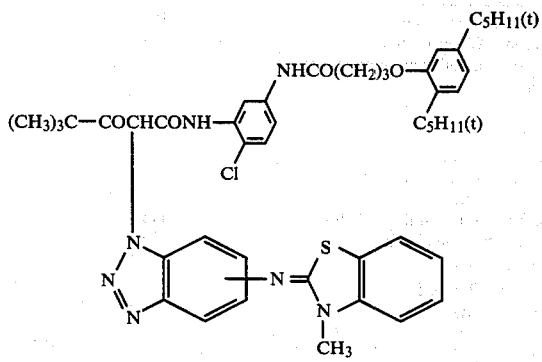

Coupler M

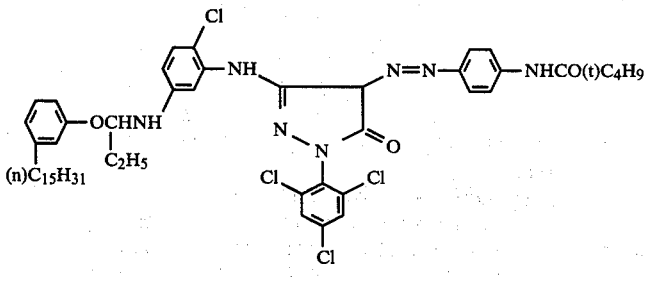

Samples 102 to 105 were prepared in the same manner as described in the preparation of Sample 101 except that Compound (I-8), Compound (I-2), Compound (I-15) and Compound (I-6), respectively, were employed in the same amount in place of Compound (I-11).

Sample 106 was prepared in the same manner as described in the preparation of Sample 101 except that the coupler A was employed in place of the coupler VI-8 and Compound (I-11) to be incorporated in $RL_2$ and that the amount of coupler A was twice that of the coupler VI-8.

Sample 107 was prepared in the same manner as described in the preparation of Sample 101 except that addition of Compound (I-11) to $RL_2$ was omitted, and a grain size of the emulsion was changed so as to have equivalent photosensitivity to that of Sample 101.

Sample 108 was prepared in the same manner as described in the preparation of Sample 101 except that the DIR coupler D was employed in place of Compound (I-11) to be incorporated in $RL_2$ and that an addition amount thereof was changed to 10 mol% to that of the coupler VI-8.

Each of the thus-obtained Samples 101 to 108 was exposed to white light through a wedge. These samples were almost equal in sensitivity and gradation.

The granularity of the cyan dye image which each of these samples provided was judged using the conventional root mean square (RMS) method. Judgement of the granularity using the RMS method is well-known in this art. Details of the RMS method is described in *Photographic Science and Engineering*, Vol. 19, No. 4, pp. 235–238 (1975) with a title "RMS Granularity; Determination of Just Noticeable Difference".

RMS values at densities of 0.3 and 1.0, respectively, are set forth in Table 1. Samples 101 to 105 which contained the compounds of this invention had excellent granularities, irrespective of image density.

Development processings employed herein were as follows:

| Development Processings | Temperature (°C.) | Time |
|---|---|---|
| 1. Color Development | 38 | 3 min 15 sec |
| 2. Bleaching | " | 6 min 30 sec |
| 3. Water Washing | " | 3 min 15 sec |
| 4. Fixing | " | 6 min 30 sec |
| 5. Water Washing | " | 3 min 15 sec |

-continued

| Development Processings | Temperature (°C.) | Time |
|---|---|---|
| 6. Stabilizing | " | 3 min 15 sec |

The processing solutions used in the above-described steps had the following compositions.

| | |
|---|---|
| Color Developing Solution | |
| Sodium Nitrilotriacetate | 1.0 g |
| Sodium Sulfite | 4.0 g |
| Sodium Carbonate | 30.0 g |
| Potassium Bromide | 1.4 g |
| Hydroxylamine Sulfate | 2.4 g |
| 4-(N—Ethyl-N—β-hydroxyethylamino)-2-methylaniline Sulfate | 4.5 g |
| Water to make | 1 l |
| Bleaching Solution | |
| Ammonium Bromide | 160.0 g |
| Ammonia Water (28%) | 25.0 ml |
| Sodium Ethylenediaminetetraacetato-ferrate (III) | 130 g |
| Glacial Acetic Acid | 14 ml |
| Water to make | 1 l |
| Fixing Solution | |
| Sodium Tetrapolyphosphate | 2.0 g |
| Sodium Sulfite | 4.0 g |
| Ammonium Thiosulfate (70%) | 175.0 ml |
| Sodium Hydrogensulfite | 4.6 g |
| Water to make | 1 l |
| Stabilizing Solution | |
| Formaldehyde | 8.0 ml |
| Water to make | 1 l |

TABLE 1

| Sample | Coupler | Compound | RMS Values D = 0.3 + fog | RMS Values D = 1.0 + fog |
|---|---|---|---|---|
| 101 | VI-8 | (I-11) | 0.0172 | 0.0124 |
| 102 | VI-8 | (I-8) | 0.0170 | 0.0124 |
| 103 | VI-8 | (I-2) | 0.0172 | 0.0125 |
| 104 | VI-8 | (I-15) | 0.0171 | 0.0124 |
| 105 | VI-8 | (I-6) | 0.0171 | 0.0124 |
| 106 | A | — | 0.0172 | 0.0150 |
| 107 | VI-8 | — | 0.0185 | 0.0126 |
| 108 | VI-8 + D | — | 0.0175 | 0.0142 |

EXAMPLE 2

On a cellulose triacetate film support were coated the layers having compositions described below in this order to prepare a multilayer color light-sensitive material.

(1) Red-sensitive emulsion layer which was made up of a silver iodobromide emulsion (iodide content: 5 mol%) containing 2.5 g/m$^2$ of silver, $6\times10^{-5}$ mol/mol Ag of the sensitizing dye I, $1.5\times10^{-5}$ mol/mol Ag of the sensitizing dye II, 0.02 mol/mol Ag of the coupler (VI-8) and 0.006 mol/mol Ag (30 mol% to the content of the coupler (VI-8)) of Compound (I-11).

(2) Protective layer which was a gelatin layer containing polymethyl methacrylate particles (having a diameter of about 1.5μ).

To each of the above-described layers, a gelatin hardener and a surface active agent were added in addition to the above-described composition.

The thus-prepared sample was named Sample 201.

Samples 202 to 206 were prepared in the same manner as described in the preparation of Sample 201 except that the coupler VI-8 and Compound (I-11) incorporated in the first layer were changed to those set forth in Table 2, respectively.

Samples 207 to 209 were prepared in the same manner as described in the preparation of Sample 201 except that any of the compounds of this invention were not incorporated in the first layer, the couplers set forth in Table 2 were employed in place of the coupler VI-8 and that grain sizes of the emulsions were changed so as to have the sensitivities equivalent to that of Sample 201, respectively.

Each of the thus-prepared samples was subjected to photographic processings and evaluated in the same manner as employed in Example 1 except that the time for color development was reduced to 2 minutes.

Results obtained are shown in Table 2.

The samples containing the compounds of this invention were superior in granularity to the samples free from the compounds of this invention, irrespective of the coupler employed in combination with the compound of this invention.

TABLE 2

| Sample | Coupler | Compound | Amount of Compound Added (mol % to coupler) | RMS Value (D = 0.3 + fog) |
|---|---|---|---|---|
| 201 | VI-8 | (I-11) | 30 | 0.018 |
| 202 | VI-13 | " | 20 | 0.014 |
| 203 | VI-27 | " | 5 | 0.015 |
| 204 | VI-8 | (I-2) | 30 | 0.017 |
| 205 | VI-13 | " | 20 | 0.013 |
| 206 | VI-27 | " | 5 | 0.014 |
| 207 | VI-8 | — | — | 0.025 |
| 208 | VI-13 | — | — | 0.018 |
| 209 | VI-27 | — | — | 0.019 |

EXAMPLE 3

Preparation of Sample 301

On a cellulose triacetate film support were coated the layers having compositions described below in this order to prepare a multilayer color light-sensitive material.

(1) Green-sensitive emulsion layer which was made up of a silver iodobromide emulsion (iodide content: 5 mol%) containing 2.5 g/m$^2$ of silver, $2.5\times10^{-5}$ mol/mol Ag of the sensitizing dye III, $0.8\times10^{-5}$ mol/mol Ag of the sensitizing dye IV, 0.02 mol/mol Ag of the coupler (V-27), and 0.004 mol/mol Ag (20 mol% to the content of the coupler (V-27)) of Compound (I-13).

(2) Protective layer which was a gelatin layer containing polymethyl methacrylate particles having a diameter of about 1.5μ.

To each of the above-described layers, a gelatin hardener and a surface active agent were added in addition to the above-described composition.

Preparation of Samples 302 to 306

These were prepared in the same manner as described in the preparation of Sample 301 except that the coupler (V-27) and Compound (I-13) incorporated in the first layer were changed to those set forth in Table 3, respectively.

Preparation of Samples 307 to 309

These were prepared in the same manner as described in the preparation of Sample 301 except that Compound (I-13) was omitted from the first layer, the coupler (V-27) was changed to those set forth in Table 3 and that grain sizes of the emulsions were changed so as to have the sensitivities equivalent to that of Sample 301, respectively.

Each of the thus-prepared samples was evaluated using the same method as employed in Example 2. Results obtained are shown in Table 3.

The samples containing the compounds of this invention, irrespective of coupler to be employed in combination therewith, were superior in granularity to the samples in which any of the compounds of this invention were not incorporated.

TABLE 3

| Sample | Coupler | Compound | Amount of Compound Added (mol % to coupler) | RMS Value (D = 0.3 + fog) |
|---|---|---|---|---|
| 301 | V-27 | (I-13) | 20 | 0.015 |
| 302 | V-12 | " | 15 | 0.015 |
| 303 | V-18 | " | 10 | 0.014 |
| 304 | V-27 | (I-10) | 15 | 0.015 |
| 305 | V-12 | " | 12 | 0.013 |
| 306 | V-18 | " | 8 | 0.014 |
| 307 | V-27 | — | — | 0.020 |
| 308 | V-12 | — | — | 0.019 |
| 309 | V-18 | — | — | 0.016 |

While the invention has been described in detail and with reference to specific embodiments thereof, it will be apparent to one skilled in the art that various changes and modifications can be made therein without departing from the spirit and scope thereof.

What is claimed is:

1. A silver halide color photographic material which contains a compound represented by the following general formula (I) and a high speed reaction type coupler represented by the following general formula (II), (V) or (VI):

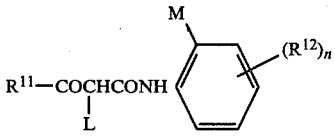

(II)

wherein $R^{11}$ represents an alkyl group or an aryl group, each of which may be substituted; $R^{12}$ represents a substituent which can be substituted for a hydrogen atom attached to the benzene ring; and n represents 1 or 2; M represents a halogen atom, an alkoxy group or an aryloxy group; and L represents a halogen atom, a $—SR^{16}$ group in which $R^{16}$ is an alkyl, aryl or acyl group or a heterocyclic residue, a $—OR^{17}$ group in which $R^{17}$ is an alkyl, aryl or acyl group or a heterocyclic residue, or a

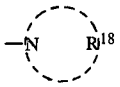

group in which $R^{18}$ is the non-metallic atoms necessary to form a 5- or 6- membered ring together with —N<, wherein the constituent atoms of said ring include C, N, O and/or S and, further, such a ring may have a substituent,

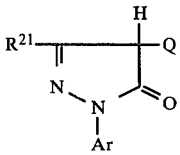

(V)

wherein $R^{21}$ represents an amino group, an acylamino group or a ureido group; Ar represents a phenyl group which may have one or more substituents; and Q represents a halogen atom, —SCN, —NCS, $R^{22}SO_2NH$—, $R^{22}CONH$—, $R^{22}OCONH$—, $R^{22}O$—, $R^{22}SO_3$—,

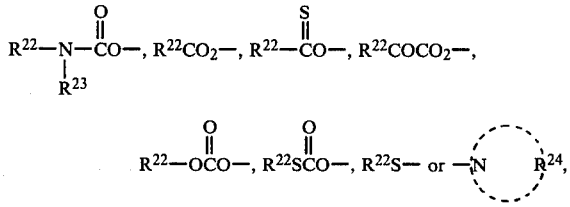

where $R^{22}$ and $R^{23}$, which may be the same or different, each is an aliphatic hydrocarbon group, an aromatic hydrocarbon group or a heterocyclic ring residue, and each may have a substituent, wherein $R^{23}$ may further be a hydrogen atom, and $R^{24}$ is the non-metallic atoms necessary to form a 5- or 6-membered ring together with —N< whose constituent atoms include C, N, O and/or S, which ring may have a substituent, $(A)_mZ$ (VI)

wherein A represents an image forming coupler residue which has a naphthol or a phenol nucleus; m represents 1 or 2; and Z represents a halogen atom, —SCN, —NCS, $—NHSO_2R^{31}$, $—NHCOR^{31}$,

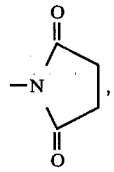

$—OR^{31}$, $—OSO_2R^{31}$, $—OCONR^{31}R^{32}$, $—OCOR^{31}$, $—OCSR^{31}$, $—OCOCO—R^{31}$, $—OCSNR^{31}R^{32}$, $—OCOOR^{31}$, $—OCOSR^{31}$ or $—SR^{31}$, where $R^{31}$ and $R^{32}$, which may be the same or different, each represents an aliphatic group, an aromatic group or a heterocyclic group, which each may have a substituent, and wherein $R^{32}$ may further represent a hydrogen atom

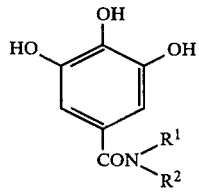

(I)

wherein $R^1$ and $R^2$ each represents a hydrogen atom, a substituted or an unsubstituted aliphatic group, a substituted or an unsubstituted aromatic group, or a substituted or an unsubstituted heterocyclic group, and they may be the same group provided that they are not simultaneously hydrogen atoms and, further, they may combine with each other to form a ring.

2. A silver halide color photographic material as claimed in claim 1 wherein the high speed reaction type coupler has general formula (II).

3. A silver halide color photographic material as claimed in claim 1 wherein the high speed reaction type coupler has general formula (V).

4. A silver halide color photographci material as claimed in claim 1 wherein the high speed reaction type coupler has general formula (VI).

* * * * *